US012053104B2

(12) United States Patent
Trojanowski

(10) Patent No.: US 12,053,104 B2
(45) Date of Patent: Aug. 6, 2024

(54) SANITARY HANDS-FREE LID DISPENSER

(71) Applicant: Craig Trojanowski, Hesperia, CA (US)

(72) Inventor: Craig Trojanowski, Hesperia, CA (US)

( * ) Notice: Subject to any disclaimer, the term of this patent is extended or adjusted under 35 U.S.C. 154(b) by 131 days.

(21) Appl. No.: 17/966,800

(22) Filed: Oct. 15, 2022

(65) Prior Publication Data

US 2024/0122373 A1 Apr. 18, 2024

(51) Int. Cl.
*A47F 1/10* (2006.01)

(52) U.S. Cl.
CPC ..... *A47F 1/106* (2013.01)

(58) Field of Classification Search
CPC ..... A47F 1/085; A47F 1/106
See application file for complete search history.

(56) References Cited

U.S. PATENT DOCUMENTS 3,795,344 A * 3/1974 Falk ..... B65G 59/105 221/241
5,038,969 A 8/1991 Berger
5,975,839 A * 11/1999 Ashby ..... B65H 3/24 221/36
6,474,503 B2 11/2002 Davis
7,882,980 B1 * 2/2011 Horn ..... G07F 11/14 221/221
9,251,640 B2 2/2016 Walsh et al.
10,529,165 B2 1/2020 Marquis et al.
2006/0242927 A1 * 11/2006 Gorzynski ..... B65B 7/2807 53/287
2007/0151982 A1 * 7/2007 Walsh ..... A47F 1/125 221/171
2011/0101017 A1 * 5/2011 Schroeder ..... B65G 59/108 221/36
2014/0166689 A1 * 6/2014 Gunderson ..... B65D 83/0038 221/221
2016/0113414 A1 * 4/2016 Weber ..... A47F 1/082 221/6
2020/0077808 A1 * 3/2020 O'Brien ..... A47F 1/06
2023/0389720 A1 * 12/2023 Johnson ..... B65G 59/066

FOREIGN PATENT DOCUMENTS

DE 10 2007 031 638 1/2009

* cited by examiner

*Primary Examiner* — Gene O Crawford
*Assistant Examiner* — Kelvin L Randall, Jr.
(74) *Attorney, Agent, or Firm* — Lewis M Brande; Law Office of Lewis Brande

(57) ABSTRACT

A sanitary hands-free beverage lid dispenser that is activated by a user that breaks a beam from an "electronic eye" which activates timers to sequentially provide compressed air to a main piston that operates a series of finger pivot assemblies, a series of separation pin assemblies and provide compressed air to "fluff" a single lid from a stack of lids within the device. The sequence of events to dispense a beverage lid separation pin activation, air blast, and ejection finger activation. The reset sequence is air blast suspended, ejection finger retract, and separation pin retract.

17 Claims, 22 Drawing Sheets

SANITARY HANDS-FREE LID DISPENSER

I. BACKGROUND OF THE INVENTION

1. Field of the Invention

This invention relates generally to devices that dispense lids for drink cups and containers without the user touching the lids in the storage container. The invention uses an electronic "eye" to sense a user's hand and sends a signal to a microprocessor that actuates fingers to dispense the lid to a holding tray.

2. Description of the Prior Art

Prior art inventions typically use mechanically activated systems to dispense lids. This is accomplished by a user activating a lever system that displaces a lid. When the lever is released, the lid is dispensed into a "catch chute" where a user will receive the lid for use. The use of a mechanical lever to dislocate the lid has some disadvantages based upon the current pandemic. The lever must be constantly sanitized to prevent the possibility of the spread of any contagion or disease from bacteria or viruses. The current invention eliminates the users need to touch the device and only need pick up the lid from the catch chute, preventing the spread of germs.

Other devices use a blade-like mechanism that moves in a direction transverse to a stack of lids to separate a single lid from the bottom of a stack of lids and move it outwardly for retrieval by the user.

In view of the foregoing, there is a need for an improved dispenser that minimizes the touching from customers and/or servers to allow a more sanitary method to provide clean and sanitary method to obtain container lids.

II. SUMMARY OF THE INVENTION

The current state of the art for automatic lid dispensers shows that there is a need for a more sanitary and effective product that will dispense lids without a user contaminating the lid as is currently done throughout the country, and the world.

In the food and beverage industry, there is a heightened potential for contamination of foods and beverages by food handlers and ordinary persons. Pathogens such as bacteria and viruses and sometimes just plain dirt may be passed onto a customer by a food handler or by a customer. as the recent pandemic has shown everyone, illness and sickness can result. The recent COVID-19 pandemic has shown everyone that it is imperative to reduce the level of human contact with food and/or beverages and their service containers in order to minimize the risk of inadvertently passing on any contagion.

Currently, commercially available beverage and food containers are presented as a cup or bowl which has a plastic lid that engages the perimeter of the cup or bowl. Conventional lid organizers typically require a server or customer to obtain a desired lid out of an open organizer, which forces the customer or server to contact not only the selected lid, but often actually causes contact with adjacent lids or covers in the organizer in order to find the correct size or shape. It is likely that any lid in this type of organizer could have been touched by more than one person whose cleanliness or hygiene may be less than desired by the end user. It is conceivable that what a server or user thinks is a clean or sanitary lid or cover is in actuality less than desired.

This current problem, and current state of the art, shows us the need for a lid or cover dispenser that minimizes the requirement for a server or customer to touch the lids in an organizer, and ultimately provide a lid for a container in a more sanitary and clean method than touching the adjacent lids in a typical organizer.

The disclosed invention uses a refillable hopper that stacks the lids vertically. A user does not touch the lids, but removes one (1) end of the product packaging and slides the package containing the lids into the hopper. A holding rod is inserted to keep the stack of lids in a pre-stage position utilizing an end cap. This achieves product loading with no product contact. The hopper is placed into position and the holding rod is removed to allow the lids to be stacked in a staging position.

The disclosed invention uses a pressurized air source such as an air cylinder or compressor with a smaller pressurized air cylinder. When the user breaks the proximity sensor, a signal is sent to a micro-chip that sends a timed sequential signal to three timed solenoid operated valves.

A separation pin isolates an individual beverage lid, a blast of air assists in isolating the lowermost beverage lid from the stack of beverage lids, A staging (ejecting) finger that is operated by an air actuated piston causes the staging fingers to pivot downwards and mechanically drives the beverage lid towards the dispensing tray. The pin plungers are timed and extend to prevent more than one lid from being dispensed per actuation. The staging and ejection finger pivots back to prepare another lid for dispensing.

The ejection sequence is as follows:

a) Separation Pin Activation;

b) Air Blast;

c) Ejection Finger Activation.

The Reset sequence is as follows:

a) Air Blast suspended;

b) Ejection Finger retract;

c) Separation Pin Retract.

The primary objective of the disclosed invention is to provide a device which dispenses a single sanitary beverage or bowl lid to a customer or worker by minimizing contact with potentially non-sanitary people. A second objective is to provide the device with a proximity (trip) sensor that causes the dispensing of a single stacked lid without requiring human contact with the single lid until after being dispensed. A third objective is to allow the device to be refilled with a stacked plurality of sanitary lids within a central hopper with pin plungers that maintain the location of the lid stack until a single lid is ready to be forced to the dispenser tray. A fourth objective is to provide a device that has all controllers and sensors within an integrated circuitry area segregated from a drive and dispensing area containing the drive mechanisms, moving parts, sanitary lids and other mechanical hardware.

Other aspects and advantages of the invention will be apparent from the description and claims that follow.

III. BRIEF DESCRIPTION OF THE DRAWINGS

FIG. 1. Shows an Isometric side view of the Sanitary Hands-Free Lid Dispenser.

FIG. 2. Shows a side view of the Sanitary Hands-Free Lid Dispenser with the side cover removed.

FIG. 3. Shows a cross-sectional view of the Sanitary Hands-Free Lid Dispenser.

FIG. 4. Shows a cross-sectional view of the Sanitary Hands-Free Lid Dispenser and the side cover.

FIG. 5. Shows rear quarter view of the Sanitary Hands-Free Lid Dispenser.

FIG. 6. Shows a right quartering view of the Sanitary Hands-Free Lid Dispenser without the mechanical sub-assembly.

FIG. 7. Shows the mechanical subassembly, which contains the major mechanical components that deposits a cup/bowl lid.

FIG. 8. Shows an exploded view of the mechanical subassembly

FIG. 9. Shows an exploded view of the major components of the mechanical subassembly.

FIG. 10. Shows a cross-sectional view of the mechanical subassembly.

FIG. 11. Shows a perspective top view of the mechanical subassembly.

FIG. 12. Shows a perspective top view of the mechanical subassembly with the loading tube flange removed showing the top view of the air manifold cap.

FIG. 13. Shows a perspective bottom view of the air manifold cap.

FIG. 14. Shows a perspective top view of the air distribution manifold assembled on the mechanical subassembly FIG. 15. Shows a bottom view of the air distribution manifold assembled on the mechanical subassembly.

FIG. 16. Shows a perspective top view of the main piston bore housing assembled on the mechanical subassembly.

FIG. 17. Shows a bottom view of the main piston bore housing.

FIG. 18. Shows a top view of the air piston with the main piston seal.

FIG. 19. Shows a perspective bottom view of the air piston.

FIG. 20. Shows a perspective top view of the staging housing extension mounted on the staging housing.

FIG. 21. Shows a side view of the finger pivot assembly with two (2) typical stacked beverage lids as reference.

FIG. 22. Shows a side view of the separation pin assembly.

FIG. 23. Shows a cross-sectional view of the separation pin assembly.

FIG. 24. Shows a left quartering view of the solenoids and air manifold.

IV. DETAILED DESCRIPTION

FIG. 1 shows, an isometric side view of the sanitary hands-free lid dispenser (10). In this overall side view, we show a loading tube cap (12), that is frictionally secured or may be permanently attached to the top of the loading tube (14). The loading tube (14) is fitted into a cylindrical hole (16) centrally located in the loading tube flange (18). The dispenser (10) has a top cover (20), where the top cover has down-turned flanges (22) that have at least two (2) holes (24) to allow fasteners (not shown) for attachment.

Continuing with FIG. 1, we have an end cover (26) located in the rear of the dispenser (10). The end cover (26) has forward-facing flanges (28) (left hand and right hand) that has holes (30) to support a front skin (32) using fasteners (not shown). The front skin (32) has holes (34) common to the forward-facing flanges (28) of the end cover (26) providing means to secure the front skin (32) to the end cover (26) using fasteners (not shown). A catch tray (36) has upturned flanges (38) and is positioned with a slope to allow a cup lid to slide towards the end where a pair of end flanges (40), which are angled towards each other, stop the movement of the cup lid. The upturned flanges (38) of the catch tray (36) that is shown, has at least two (2) holes (42) that match to corresponding holes (44) on the front skin (32) and use fasteners (not shown) to attach the catch tray (36) to the front skin (32).

In order to support the hands-free lid dispenser (10) we show a first support bracket (292) a second support bracket (294) (not shown in this view), and a stand (296). The stand (296) has a first vertical portion (302) and a second vertical portion (304) that are connected to each other with a base (306) where the base (306) may be circular or rectangular in shape. The first and second support brackets (292, 294) are mounted on opposing sides of the end cover (26). The first and second support brackets (292, 294) are rectangular in shape and have holes on a top surface (298) and a bottom surface (300) that are adapted to receive the vertical portions of the stand (296).

The hands-free lid dispenser (10) further has a first sensor (308) and a second sensor (310), where the first sensor (308) has a first sensor housing (312) and the second sensor (310) has a second sensor housing (314). The first sensor housing (312) and the second sensor housing (314) are positioned opposing each other and fastened onto the front skin (32) of the hands-free lid dispenser (10). The first and second sensor (308, 310) are aligned and provide a cycle trip beam (318) that when interrupted by an opaque object, activates the mechanism to dispense a single lid into the catch tray (36). The hands-free sanitary lid dispenser (10) is provided with a low product indicator (316) that when tripped, visually indicates to the users that the loading tube (14) needs refilling.

FIG. 2 shows, a side view of the sanitary hands-free lid dispenser (10) without the front skin (32). In this side view, we can see some of the internal mechanical and electronic components. As in FIG. 1, we show a loading tube cap (12), frictionally secured onto the top of the loading tube (14). The loading tube (14) is fitted into a cylindrical hole (16) centrally located in the loading tube flange (18). The dispenser (10) has a top cover (20), where the top cover has down-turned flanges (22) that have holes (24) to allow fasteners (not shown) for attachment.

Continuing with FIG. 2, we see the end cover (26) located in the rear of the dispenser (10). The end cover (26) has forward-facing flanges (28) (left hand and right hand) that has holes (30) to support a front skin (32). The catch tray (36) has upturned flanges (38) and is positioned with a slope to allow a cup lid to slide towards the end where a pair of end flanges (40), which are angled towards each other, stop the movement of the cup lid. The upturned flanges (38) of the catch tray (36) shows the two (2) holes (42) that are matched to the corresponding holes (44) on the front skin (32). A mechanical subassembly (46) is shown which comprises the mechanical and pneumatic components of the dispenser (10). A splash guard (252) is shown surrounding the bottom of the mechanical sub-assembly (46). The splash guard (252) is semicircular ins overall shape and is sized to surround half of the outer diameter of the mechanical sub-assembly (46) and is trimmed to provide minimal gap to the catch tray (36). The splash guard (252) prevents liquid from contaminating and damaging the electronics of the sanitary hands-free lid dispenser (10).

With FIG. 3 thru FIG. 9, we get a better understanding of how the novel invention is assembled. FIG. 3 shows a cross sectional view of an assembled dispenser (10). The loading tube cap (12) is on top of the loading tube (14). The loading tube flange (18) is defined as a L-shaped cylinder of revolution that has a centrally located cylindrical hole (16). The loading tube flange (18) has a ledge (46) which provides support for the loading tube (14). The loading tube flange (18) has an externally extending flange (50) that rests upon the mechanical subassembly (46). The loading tube flange (18) has an upstanding leg (370) where a semi-circular trim (364) is provided and provides clearance to a circular rod (368) that us used to temporarily secure the beverage lids when they are in the loading tube (14). The loading tube (14) has a pair of thru holes (366) that are adapted to allow the circular rod (368) to be slidably inserted and removed. The pair of thru holes (366) are positioned on an opposite end (372) of the loading tube cap (12) but are positioned so as to not support the loading tube (14) when the loading tube (14) is resting on the ledge (18) of the loading tube flange (18). When needed, the loading tube (14) is removed from the loading tube flange (18). A user will take a package of beverage lids still in the plastic container and place the beverage lids and container into the loading tube (14). The user will then remove the plastic covering and insert the circular rod (368) into the thru holes (366) preventing the beverage lids from dropping out from the loading tube (14). The loading tube (14) will then be placed into the loading tube flange (18) where the user will then remove the circular rod (368) allowing the beverage lids to be re-stacked.

The mechanical subassembly (46) is comprised of many components. The loading tube flange (18) rests upon a top surface (52) of an air manifold cap (54). The air manifold cap (54) is defined as a cylinder of revolution, and has a central hole (58) defined therein. The air manifold cap (54) rests upon the top surface (62) of an air manifold (56). The air manifold (56) is defined as a cylinder of revolution and also has a central hole (60) defined therein.

A sleeve (64) is shown, the sleeve having a "L" shaped cross section cylinder of revolution having a centrally positioned cylinder (66), an outward extending flange (68), The sleeve (64) has a central through hole (70) defined therethrough. Situated around the centrally positioned cylinder (66) are a plurality of slots (72), the slots allowing an ejecting finger (74) to pivot through, where the slots (72) extend through the through hole (70). The plurality of slots (72), herein shown as 8 slots, but may be greater or fewer as required by the inventor, and are equally circumferentially positioned. Interspaced and equally circumferentially located between the plurality of slots (72) are separation pin assembly holes (76).

Resting on a top surface (78) of the outward extending flange (68) of the sleeve (64) is a staging housing extension (80). The staging housing extension (80) is defined as a cylinder of revolution an has a central hole (82) defined therein. The staging housing extension (80) has cutouts (192) to allow a plurality of finger pivot assemblies (84), in this embodiment, shown as eight finger pivot assemblies (84), but may be greater of fewer as required by the inventor, to have clearance to allow the ejecting finger (74) to easily rotate and translate. The finger pivot assemblies (84) are situated to allow each of the ejecting finger (74) to pass through the slots (72) located in the sleeve (64).

A staging housing (88) having a top surface (90), a bottom surface (92), an exterior surface (94) is shown. The staging housing (88) is defined as a cylinder of revolution, and has a through hole (96) centrally located penetrating through the top and bottom surfaces (90, 92). A series of eight (8) clearance slots (98) are provided to allow the staging housing (88) to be mounted onto the top surface (86) of the staging housing extension (80). The clearance slots (98) penetrate from the exterior surface (94) to the through hole (96) of the staging housing (88). The clearance slots (98) may be stepped to provide adequate clearance to a finger pivot anchor (100) which is part of the finger pivot assemblies (84). The staging housing (88) further has through holes (102) herein shown as eight (8) through holes (102), that accommodate all the separation pin assemblies (200) and are positionally in line with the separation pin assembly holes (76) in the sleeve (64). The staging housing (88) further has a plurality of counterbores (104) herein shown as eight (8) counterbores (104), that are located on the top surface (86) and are designed to accommodate a plurality of piston springs (106) herein shown as eight piston springs (106). The piston springs (106) protrude beyond the top surface (90) of the staging housing (88).

The finger pivot assemblies (84) further have an shoulder cap screw (108) and a spring (110) where the shoulder cap screw (108) slideably penetrate through the staging housing (88) through a plurality of screw holes (112). The shoulder cap screw (108) is threadably inserted into the finger drive shaft (230).

A main piston bore housing (124) is provided to house a main piston (114). The piston bore housing (124) is defined as a modified "C" shaped cylinder of revolution having an internal gap (196) to house the main piston (114)

A main piston (114) is provided, where the main piston (114) is driven by a pneumatic burst of air. The piston (114) is an "L" shaped cylinder of revolution and has a top surface (116) a bottom surface (118), a thru hole (120). The thru hole (120) is adapted to slidably move along the outer surface (122) of the sleeve (64). Also located on the bottom surface (118) are a plurality of counterbores (198), where each of the counterbores (198) are adapted to receive the spring (110) and are in line with the counterbores (104) in the staging housing (88). When assembled, the piston springs (106) maintain a gap between the top surface (90) of the staging housing (88) and the bottom surface (114) of the main piston (114). The piston slideably fits in a piston bore housing (124). The top surface (116) of the main piston (114) is adapted to receive a main piston seal (194). The main piston seal (194) is adhered to the top surface (116) of the main piston (114) and prevents a loss of pressurized air necessary to activate the main piston (114).

FIG. 4 shows, a side view of the sanitary hands-free lid dispenser (10) with the front skin (32) shifted away from the sanitary hands-free lid dispenser (10). In this side view, we can see some of the internal mechanical and electronic components. As in FIG. 1, we show a loading tube cap (12), frictionally secured, or may be permanently attached to the top of the loading tube (14). The loading tube (14) is fitted into a cylindrical hole (16) centrally located in the loading tube flange (18). The dispenser (10) has a top cover (20), where the top cover has down-turned flanges (22) that have holes (24) to allow fasteners (not shown) for attachment. The end cover (26) located in the rear of the dispenser (10). The end cover (26) has forward-facing flanges (28) (left hand and right hand) that has holes (30) to support a front skin (32). The catch tray (36) has upturned flanges (38) and is positioned with a slope to allow a cup lid to slide towards the end where a pair of end flanges (40), which are angled towards each other, stop the movement of the cup lid. The upturned flanges (38) of the catch tray (36) shows the two (2) holes (42) that are matched to the corresponding holes (44) on the front skin (32). A mechanical subassembly (46) is shown which comprises the mechanical and pneumatic components of the dispenser (10).

FIG. 5 shows a rear quartering view of the sanitary hands-free lid dispenser (10). We show the first and second support bracket (292, 294) which is attached to the end cover (26), and the stand (296) supporting the sanitary hands-free lid dispenser (10). A fuse and connector or input (320) is located towards the bottom of the end cover (26) and provides between 5 volts and 24 volts, 3-amp power to the electrical system. A fuse (322) and cover (324) is shown towards the middle portion of the end cover (26). Towards the middle top of the end cover (26) an input supply air fitting (326) is shown. In order for the system to actuate correctly the input pressure was tested and determined to be 30 psi to 35 psi. the input supply air fitting (326) communicates with an air manifold (328) which supplies air to a first solenoid (330), a second solenoid (332), and a third solenoid (334). The air manifold is positioned towards the top of the end cover (26) or the component mounting board (390). A first low product sensor (336) and a second low product sensor (338) are shown facing each other and providing a beam between the first low product sensor (336) and the second low product sensor (338) where an uninterrupted beam provides a signal to illuminate the low product indicator (316). Conversely, when the beam between the first low product sensor (336) and the second low product sensor (338) is interrupted because enough product are in the loading tube (14), the low product indicator (316) will remain off.

FIG. 6 shows a right quarter view of the component mounting board (390). The component mounting board (390) is attached to the end cover (26). The first and second solenoids (330, 332) are three-way solenoids which initially provide pressurized air to activate the mechanisms and where they also allow pressure relief after the activation of the sanitary hands-free lid dispenser (10). The third solenoid (334) is a two-way solenoid as there would be no requirement to relieve the air pressure since it vents to the atmosphere. The air manifold (328) is shown centrally positioned towards the top of the component mounting board (390).

FIG. 9 shows how the mechanical subassembly (46) is assembled. We show the sleeve (64) the centrally positioned cylinder (66), and the outward extending flange (68). The staging housing extension (80) is shown and the central hole (82) is sized to slip fit over the centrally positioned cylinder (66) of the sleeve (64). The finger pivot assemblies (84) are shown fitting in the cutouts (192) of the staging housing extension (80). We next show the staging housing (88) with its central through hole (96). The central through hole (96) of the staging housing (88) is sized to slip fit over the centrally positioned cylinder (66) of the sleeve (64). The clearance slots (98) are shown and allow the finger pivot assemblies (84) to be mounted onto the Staging housing (88) and be positioned coincident with the cutouts (192) in the staging housing extension (80). The thru holes (102) in the staging housing (88) are sized for the separation pin assemblies (200). The piston springs (106) are shown and are positioned in the counterbore (104) located in the top surface (88) of the staging housing (80).

With respect to FIG. 10, we show a detailed cross section that depicts the mechanical subassembly (46) in detail aiding in understanding the invention. The loading tube flange (18) is shown having a clearance trim (126) that clears a set of 3 threaded fittings (128) (see FIGS. 11 and 12) not shown for clarity. The threaded fittings (128) are threadably inserted into a first (130), a second (132), and a third (134) threaded holes in the air manifold cap (54). The loading tube flange (18) has a ledge (48) to support the loading tube (14) when inserted into the loading tube flange (18).

FIG. 10 continues to show that the bottom side of the air manifold cap (54) which bears against a top side (160) of the air manifold (56).

FIG. 10 shows a cross section of the piston bore housing (124) and the relationship of the piston (114). The piston bore housing (124) has an external flange (184) and an internal flange (186), where the external flange (186) has an outer surface (188), and the internal flange (186) has an inner surface (190). The outer surface (188) of the external flange (186) generally aligns with the exterior surface (94) of the staging housing (88). The inner surface (190) of the piston bore housing (124) (internal flange (190)) slidably adapted to fit over the centrally positioned cylinder (66) of the sleeve (64). The piston bore housing (124) shows that there is a gap (196) between the external flange (184) and the internal flange (186) to allow the piston (114) to slidably translate within the gap (196).

Figure 13:
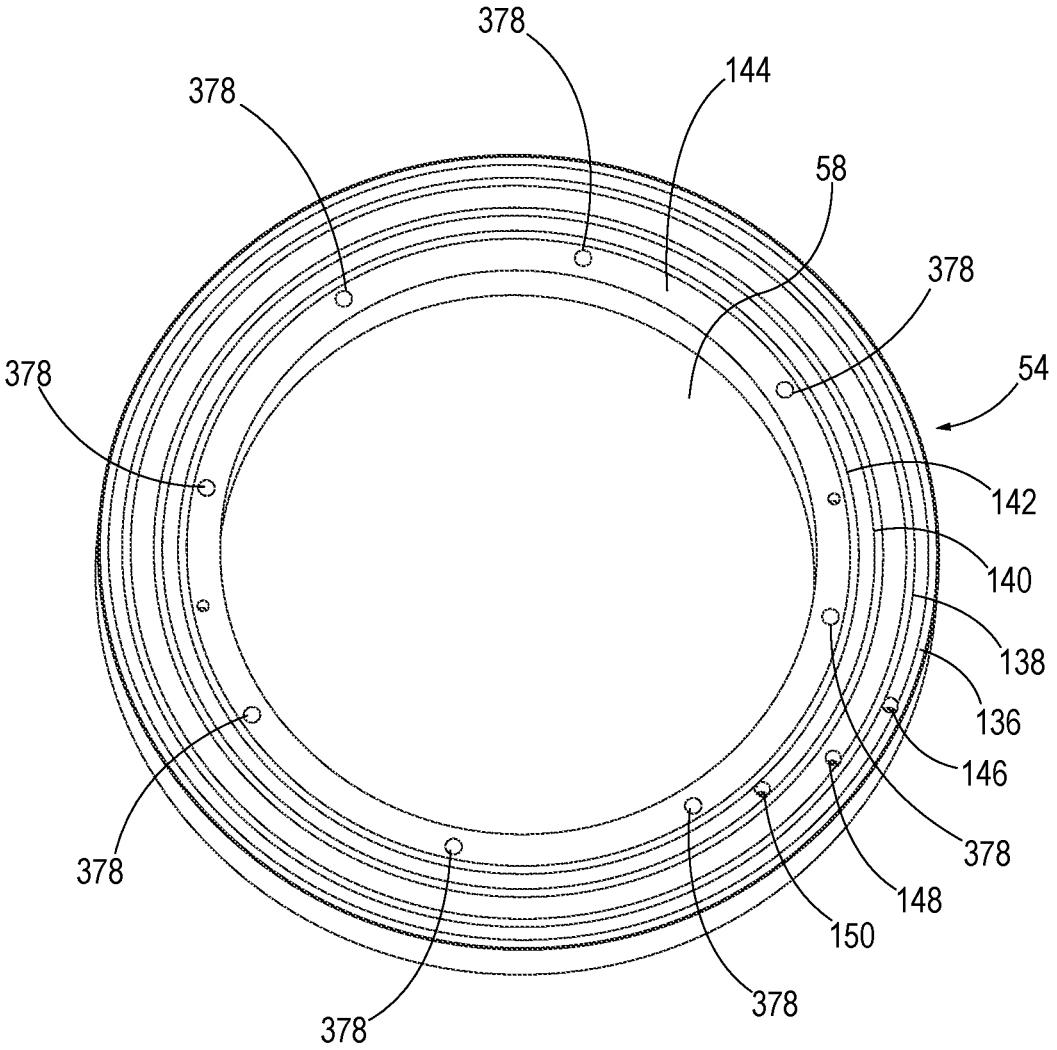

FIG. 13 shows the bottom view of the air manifold cap (54). The air manifold cap (54) is a thin cylinder that has a first (136), a second (138), a third (140), and a fourth (142) groove machined into the bottom side (144) of the air manifold cap (54). As previously described, the air manifold cap (54) is shown with a central hole (58). The bottom side (144) of the air manifold cap (54) shows that the corresponding threaded holes (130, 132, 134) have a first (146), a second (148), and a third (150), airhole, where each airhole (146, 148, 150) communicates with the corresponding threaded fittings (128) and provide pressurized air to activate the invention. Positioned in the first groove (136) is a first "O" ring (152), positioned in the second groove (138) is a second "O" ring (154), positioned in the third groove (140) is a third "O" ring (156) and positioned in the fourth groove (142) is a fourth "O" ring (158). The first, second third, and fourth "O" rings (152, 154, 156, 158) provide a seal to prevent any loss of pressurized air to actuate and isolate from cross-activation of functions of the invention.

Figure 14:
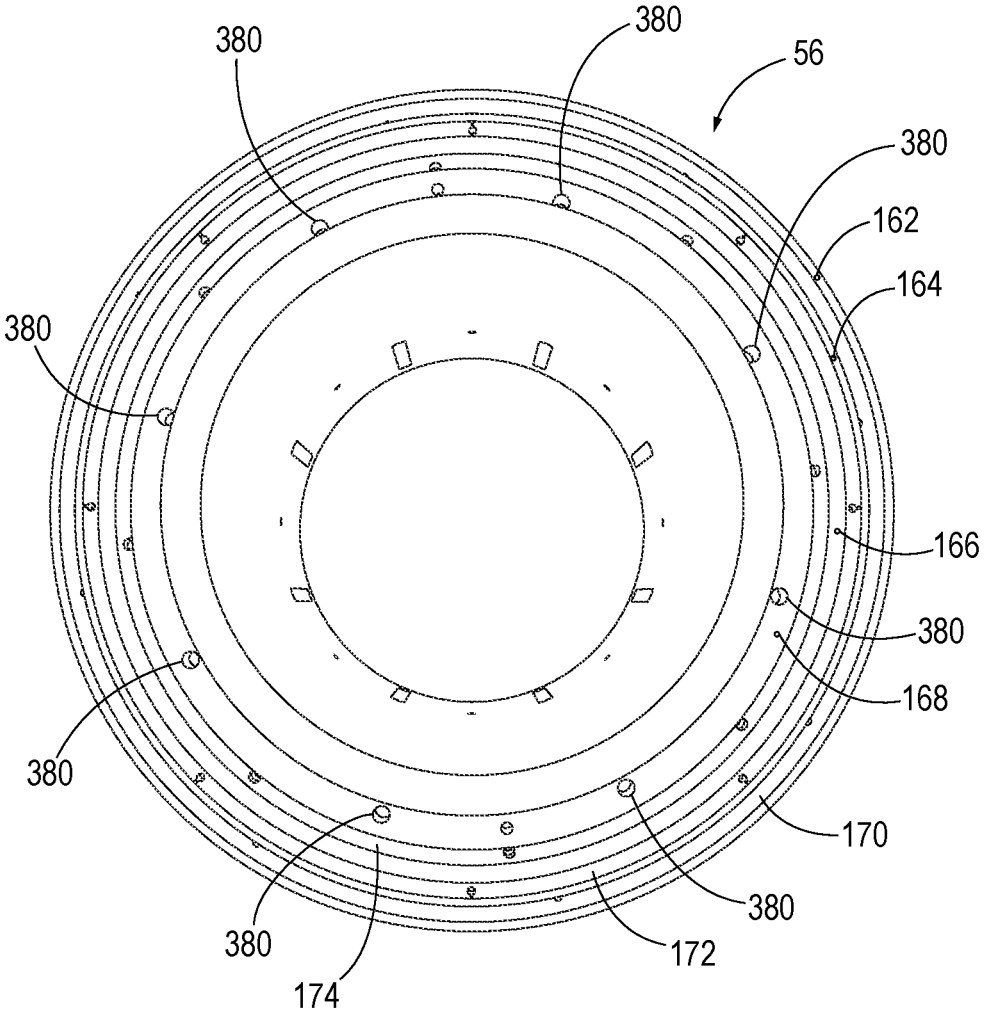

FIG. 14 is a perspective top view of the air manifold (56) and gives us a more detailed understanding of the air manifold (56). The top side (160) of the air manifold has a first ledge (162), a second ledge (164), a third ledge (166), and a fourth ledge (168) defined thereon creating a first groove (170), a second groove (172), and a third groove (174). The first, second, third, and fourth ledge (162, 164, 166, 168) provide a flat surface for the First, second, third, and fourth "O" rings (152, 154, 156, 158) to compress against and provide the full seal for the pressurized air to be transmitted fully to the first, second, and third grooves (170, 172, 174) in the air manifold (56). It is critical the first groove (170) in the air manifold (56) aligns with the first airhole (146) in the air manifold cap (54) the second groove (172) in the air manifold (56) aligns with the second airhole (148) in the air manifold cap (54), and the third groove (174) in the air manifold (56) aligns with the third airhole (150) in the air manifold cap (54). Moving to FIG. 15, we show the bottom side (176) of the air manifold (56). The air manifold (56) has a first series of air holes (178), where the first series of airholes (178) are used to actuate the main piston (114). The first series of airholes (178) are concentrically located within the third groove (174) in the air manifold (56). A second series of air holes (180) is concentrically located within the second groove (172) of the air manifold (56). The second series of air holes provided compressed air to actuate the separation pin assemblies (200). A third series of air holes (182) is concentrically located within the first groove (170). The third series of air holes (182) provides air to "fluff" the lids for dispensing.

Figure 15:
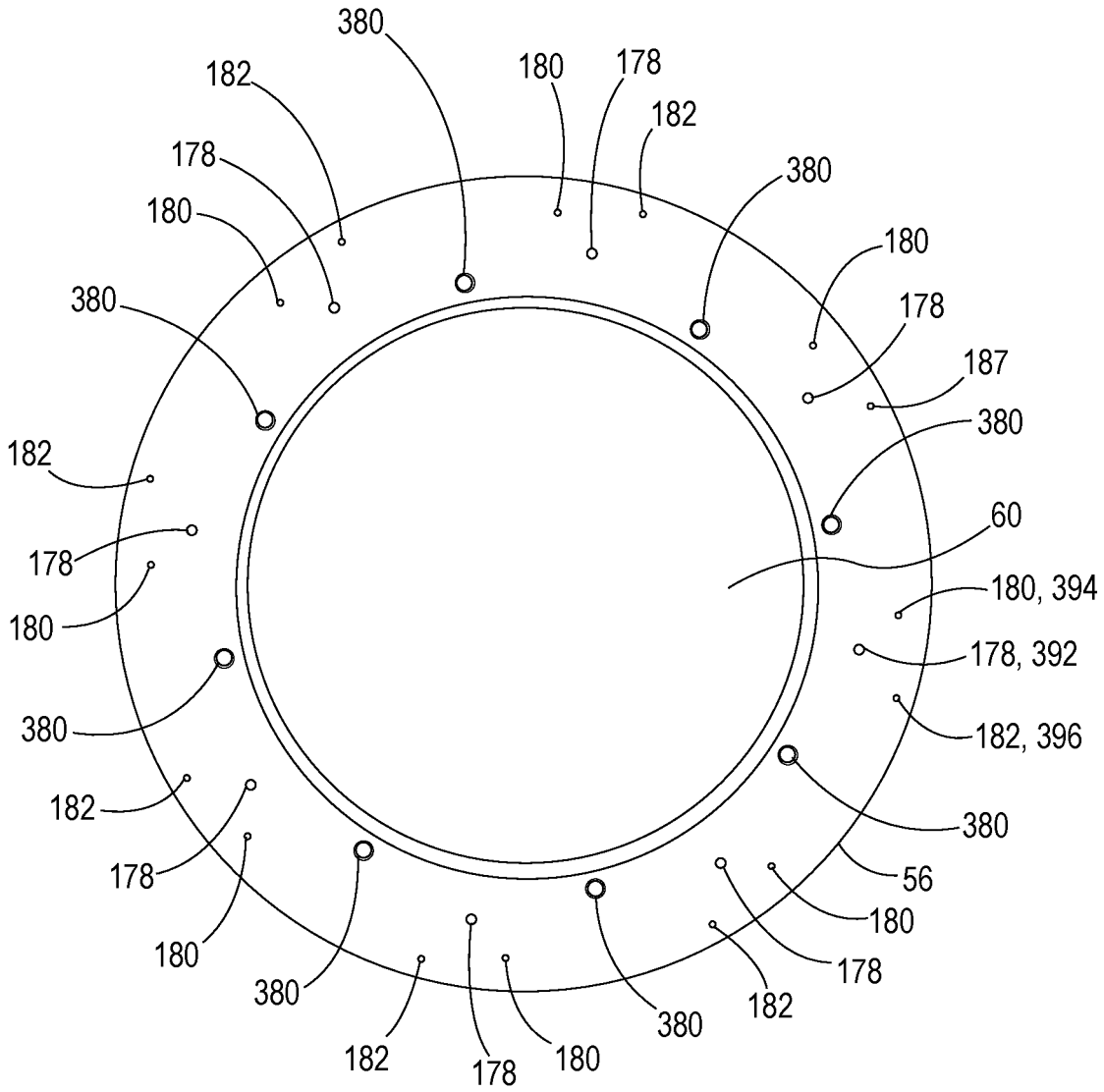

FIG. 15 shows us the bottom side (176) of the air manifold (56). A first series of air holes (178) is shown concentrically located and positioned within the third groove (174) of the air manifold (56). The first series of air holes (178) penetrate through the third groove (174) and provide pressurized air to activate the main piston (114). The second series of air holes (180) are shown concentrically located and positioned within the second groove (172) in the air manifold (56). The second series of air holes (180) penetrate through the second grove (172) and provide pressurized air for the separation pin assemblies (200). The third series of air holes (182) are shown concentrically located and positioned within the first groove (170) and provide pressurized air to "fluff" the stack of lids.

Figure 10:
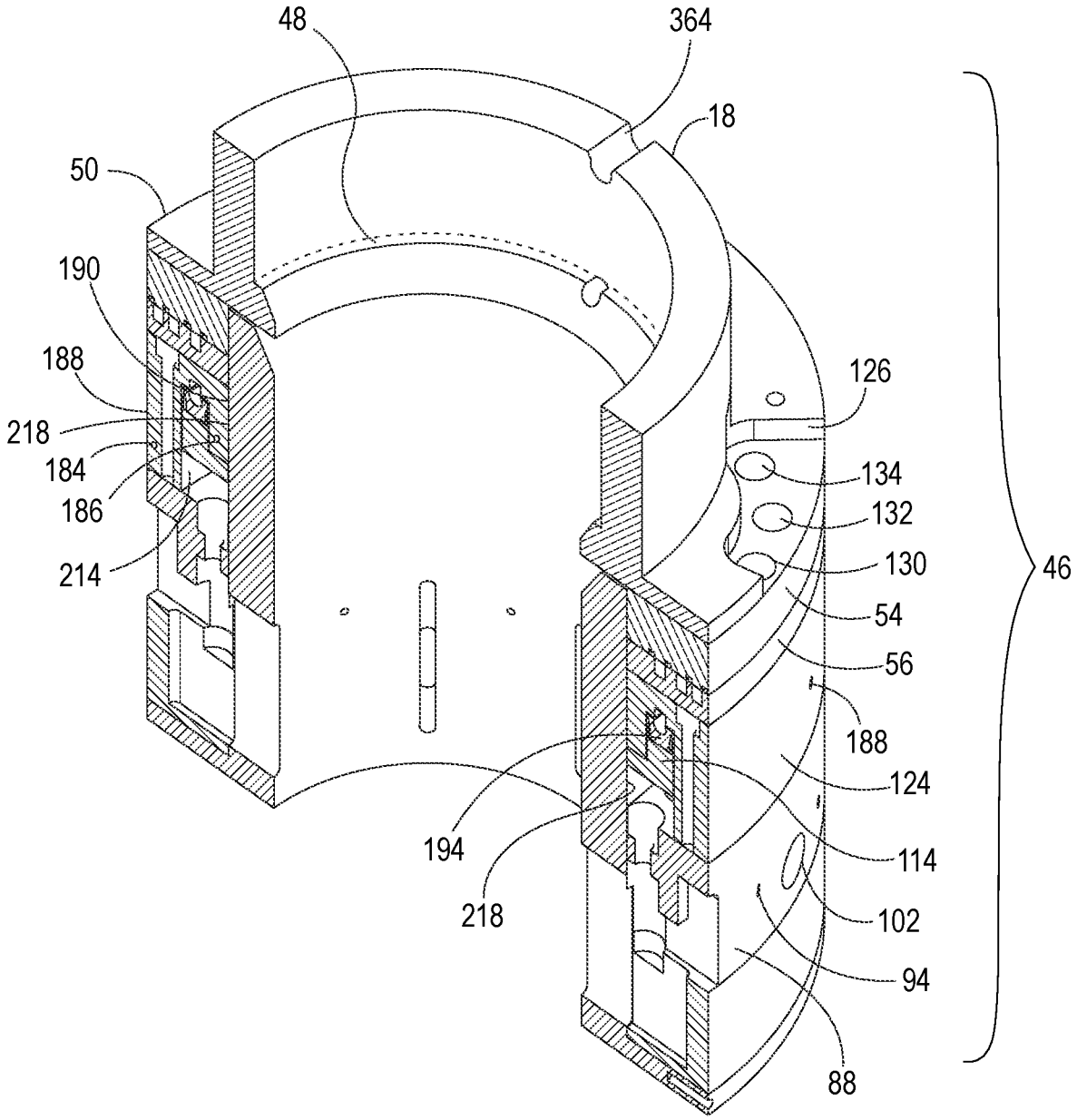
Figure 11:
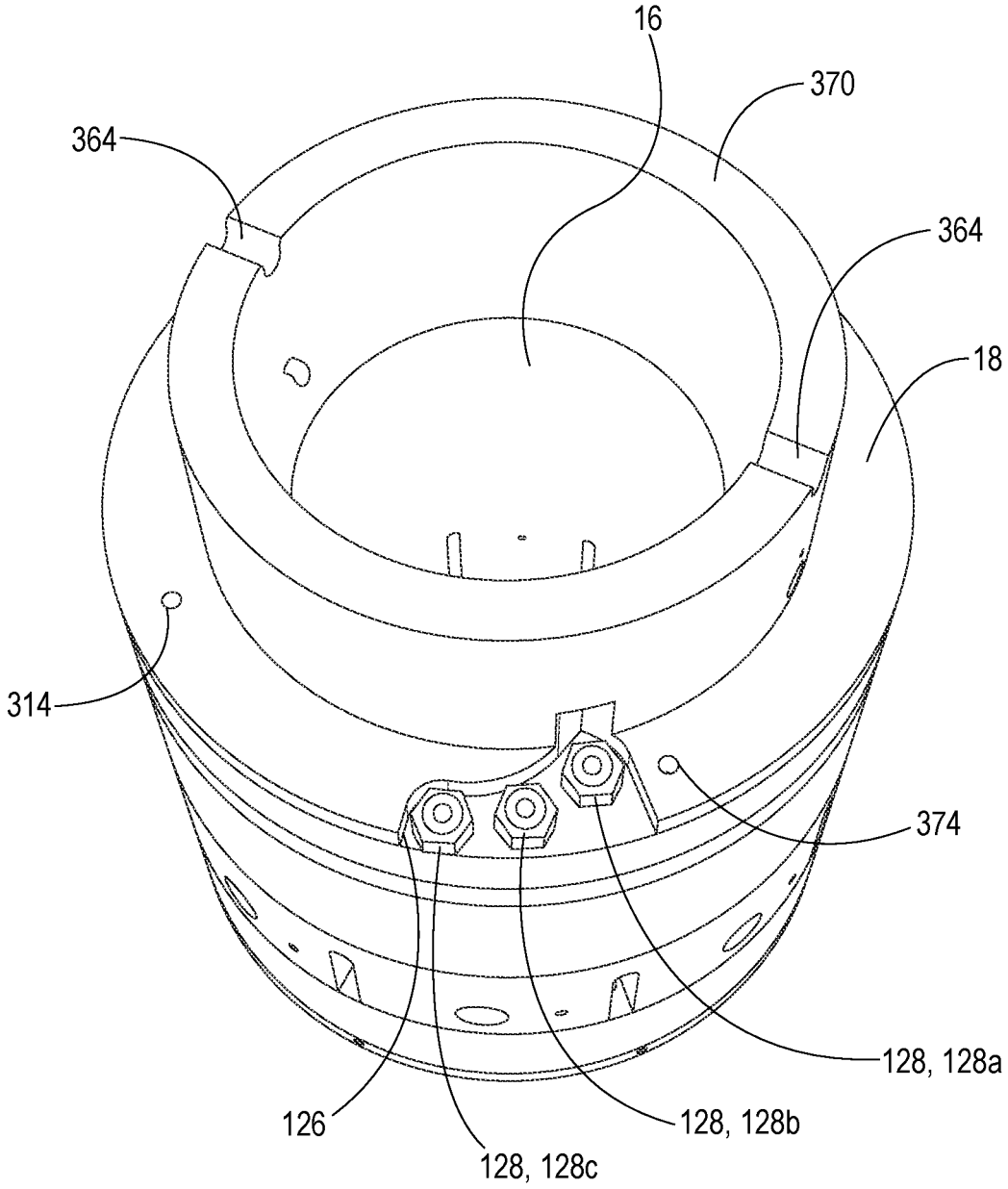
FIG. 11 shows a perspective top-down view of the invention. We show the loading tube flange (18) located with the clearance trim (126) allowing access to the threaded fittings (128).
Figure 12:
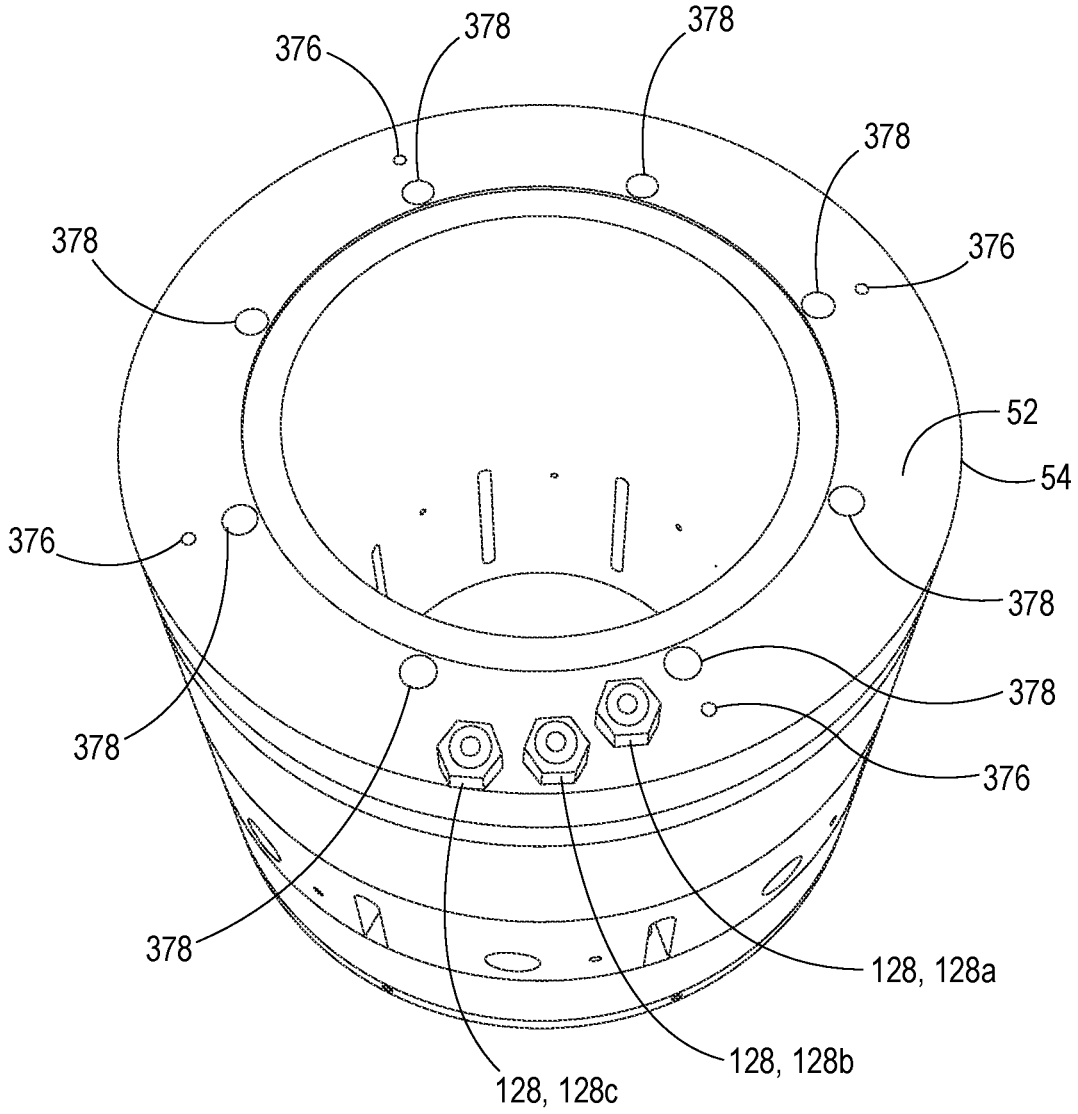
FIG. 12 shows the perspective top-down view of the invention with the loading tube flange (18) removed. As can be seen, the threaded fittings (128) are shown threadably inserted into the top surface (52) of the air manifold cap (54).
Figure 16:
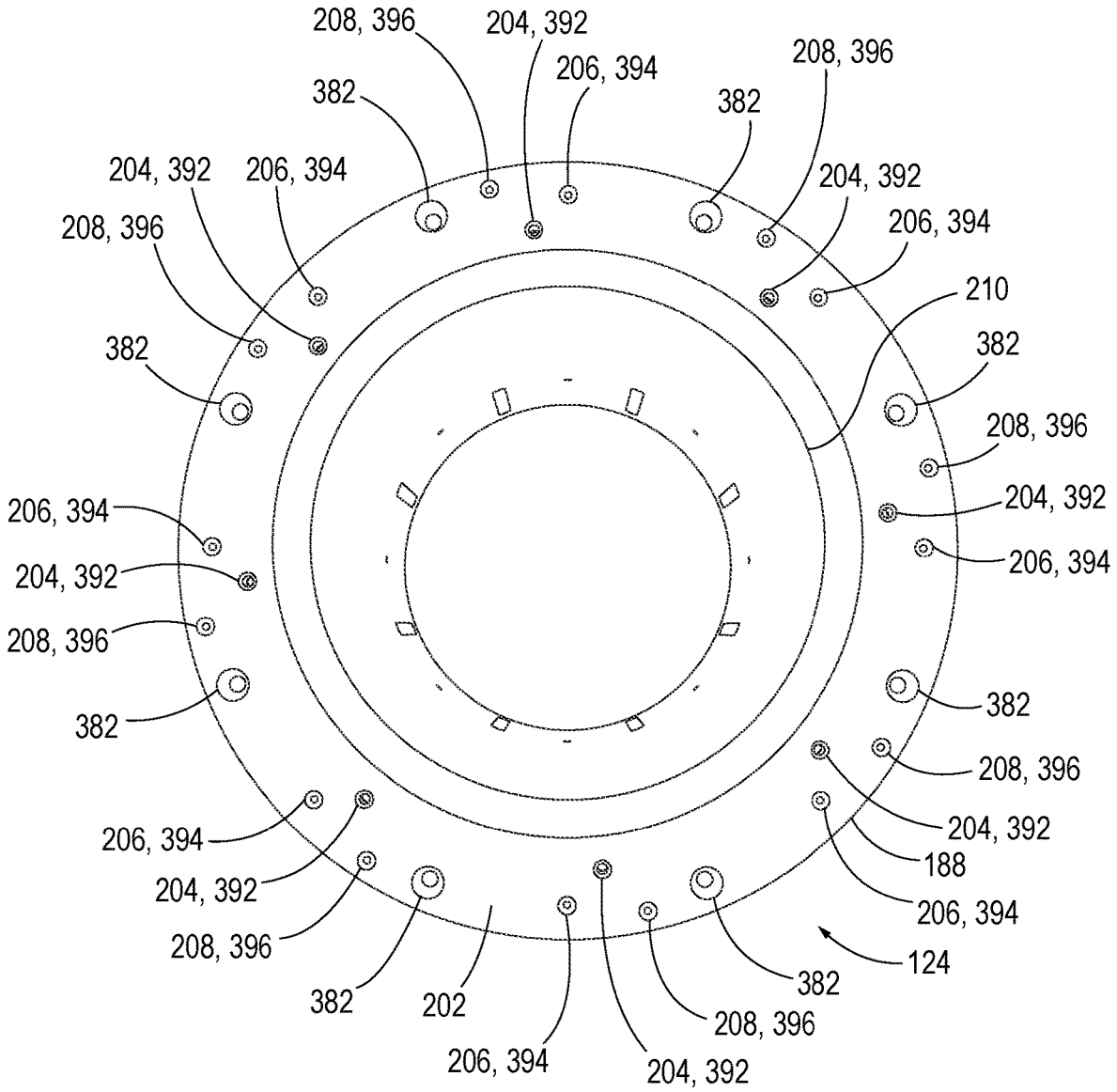

FIG. 16 shows the perspective top side view of the piston bore housing (124). A top surface (202) is shown. A central hole (210) is shown to allow a stack of lids to be positioned. A first series of air thru holes (204) is shown where the first series of air thru holes (204) are concentrically located and positioned within the gap (196) as described in FIG. 10 and FIG. 17. The first series of air thru holes (204) provide the pressurized air to activate the main piston (114). A second series of air thru holes (206) is shown where the second series of air thru holes (206) are concentrically located and on the top surface (202) of the piston bore housing (124) as described in FIG. 10 and FIG. 17. The second series of air thru holes (206) provide the pressurized air to activate the separation pin assemblies (200). A third series of air thru holes (208) is shown where the third series of air thru holes (208) are concentrically located and on the top surface (202) of the piston bore housing (124) as described in FIG. 10 and FIG. 17. The third series of air thru holes (208) provide the pressurized air to fluff the lids. The second and third series of air thru holes (206, 208) penetrate the top and bottom surfaces (202, 212) of the piston bore housing (124). The first, second and third series of air thru holes (204, 206, 208) located on the top surface (202) of the piston bore housing (124) are slightly counterbored to provide accommodation for a first, second and third series of o-rings (392, 394, 396) to be placed therein providing a seal between the main piston bore housing (124) and the bottom side (176) of the air manifold (56).

Figure 17:
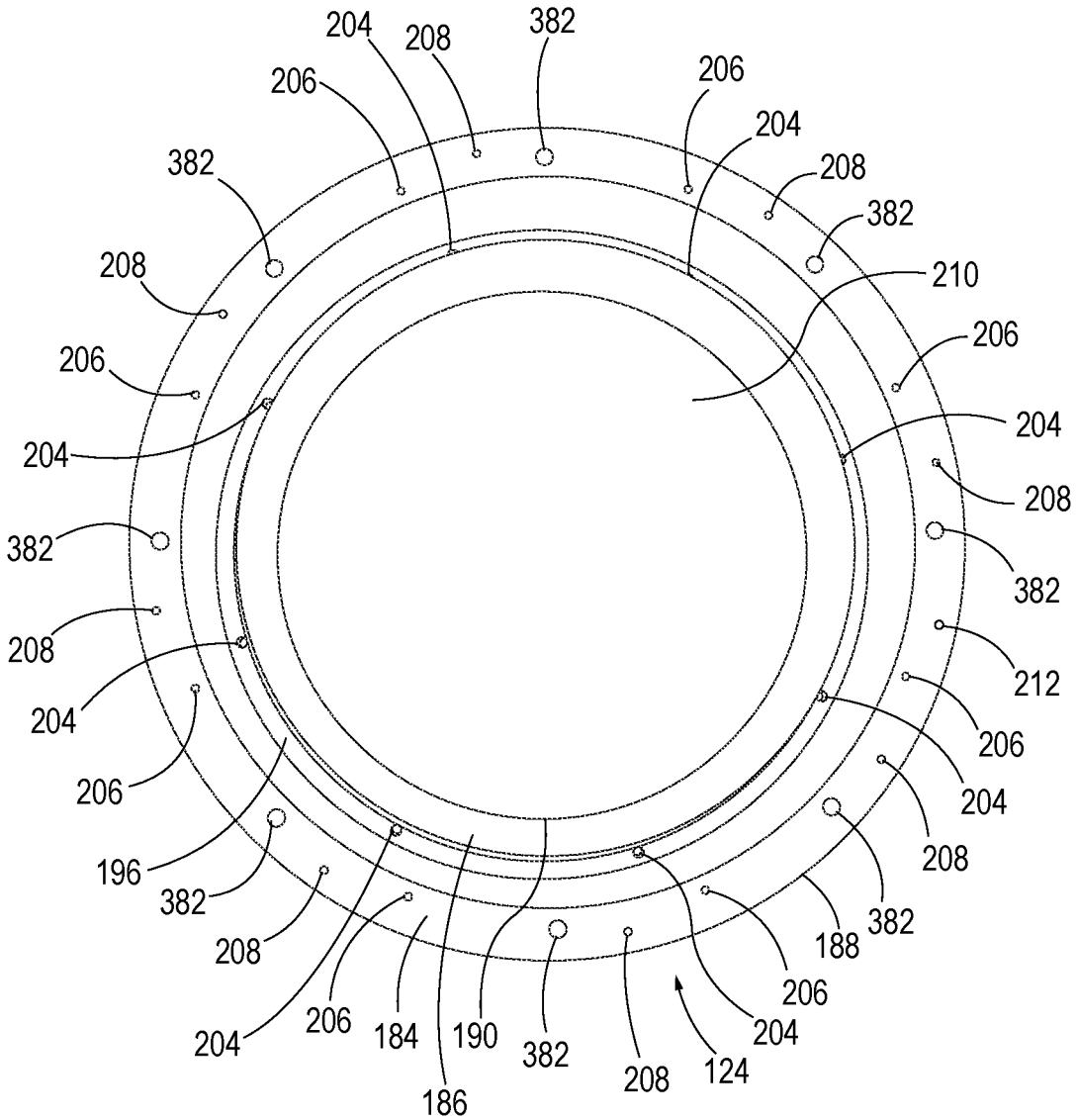

FIG. 17 shows the bottom side of the piston bore housing (124). A bottom surface (212) is shown. The central hole (210) is shown which allow a stack of lids to be positioned. the first series of air thru holes (204) is shown, where the first series of air thru holes (204) are concentrically located and positioned within the gap (196) as described in FIG. 10. As previously described the first series of air thru holes (204) provide the pressurized air to activate the main piston (114). The second series of air thru holes (206) is shown, where the second series of air thru holes (206) are concentrically located and positioned on the bottom surface (212) of the piston bore housing (124) as described in FIG. 10. The second series of air thru holes (206) provide the pressurized air to activate the separation pin assemblies (200). A third series of air thru holes (208) is shown where the third series of air thru holes (208) are concentrically located and on the bottom surface (212) of the piston bore housing (124) as described in FIG. 10. The third series of air thru holes (208) provide the pressurized air to fluff the lids. The second and third series of airholes (206, 208) penetrate the top and bottom surfaces (202, 212) of the piston bore housing (124).

Figure 18:
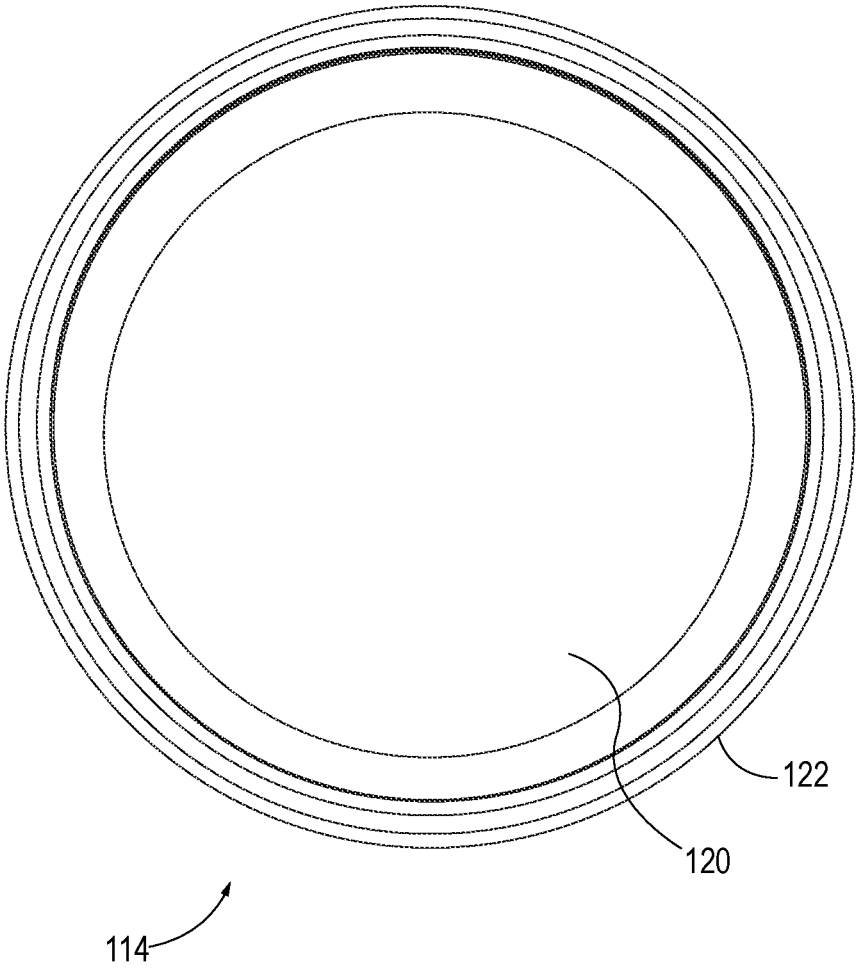

FIG. 18 shows the top surface (116) of the main piston (114). As previously disclosed, the main piston (114) has a thru hole (120) defined therein. The outer surface (122) of the main piston (114) would slideably bear against an inner surface (214) of the external flange (184) of the piston bore housing (124) (see FIG. 10). Adhered to the main piston (114) is a main piston seal (194). In this embodiment, the main piston seal (194) is essentially u-shaped where the base (216) of the main piston seal (194) is adhered to the top surface (116) of the main piston (114). The main piston seal (194) bears against the inner surface (214) and external surface (218) defined by the gap (196) in the main piston seal (194).

Figure 19:
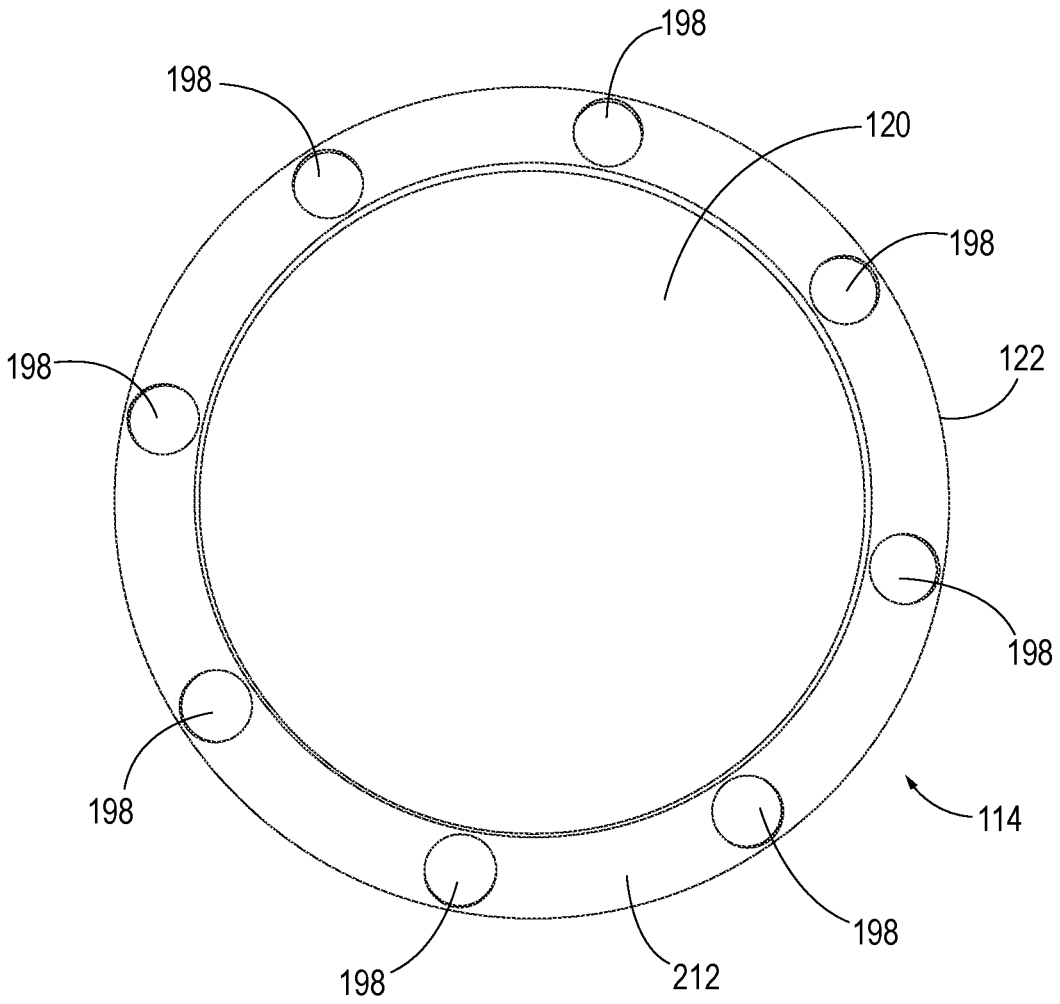

Continuing with FIG. 19, we show the bottom surface (212) of the main piston (114). The bottom surface (212) of the main piston (114) shows a series of counterbores (198) to provide positional location and recesses for the main piston (114) and the piston springs (106).

Figure 20:
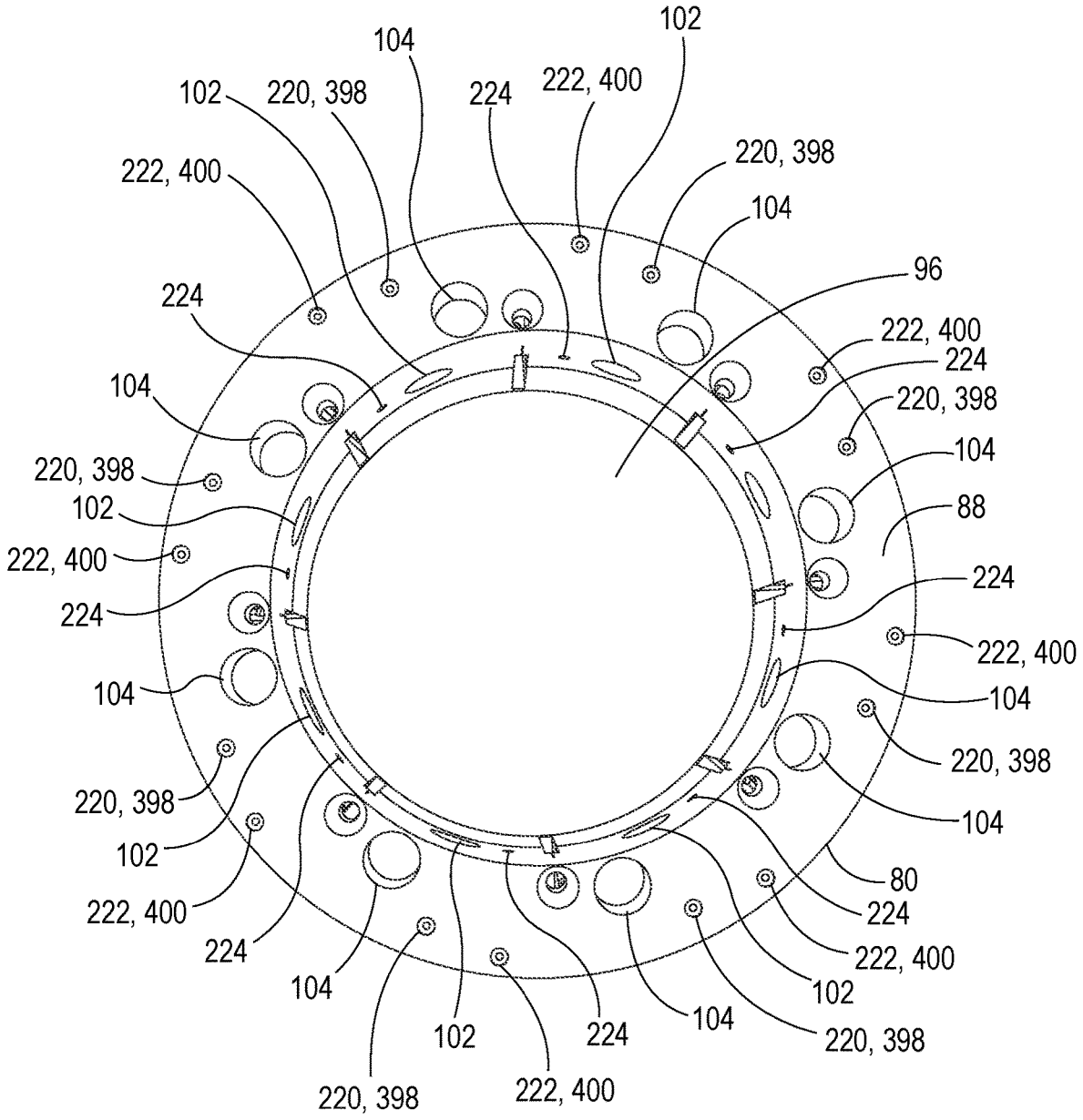

FIG. 20 shows the top surface (90) of the staging housing (88). The thru-hole (96) is clearly shown. The top surface (90) of the staging housing (88) shows a series of counterbores (104) where the counterbores are deep enough to allow the piston springs (106) to slip fit and allow the piston springs to protrude above the top surface (90) of the staging housing (88). A first series of air-ports (220) is shown on the top surface (90) of the staging housing (88). The first series of air-ports (220) are in line and directly communicate with the second series of thru-holes (206) located in the piston bore housing (124). The first series of air-ports are slightly counterbored and accommodate a first series of o-rings (398). These first series of air-ports (220) penetrate thru and allow compressed air to communicate with the thru-holes (102) located in the staging housing (88) providing compressed air to actuate the separation pin assemblies (200) (see FIGS. 9 and 10). Also shown is a second series of air-ports (222) is shown on the top surface (90) of the staging housing (88). The second series of air-ports (222) are slightly counterbored to accommodate a second series of o-rings (400). The second series of air-ports (222) penetrate through the staging housing is shown on the top surface (90) of the staging housing (88) and exit into the thru-hole (96) via a plurality of exit ports (224). The first and second o-rings (398, 400), seal the top surface (212) of the main piston housing (124) to the top surface (90) of the staging housing (88).

Figure 21:
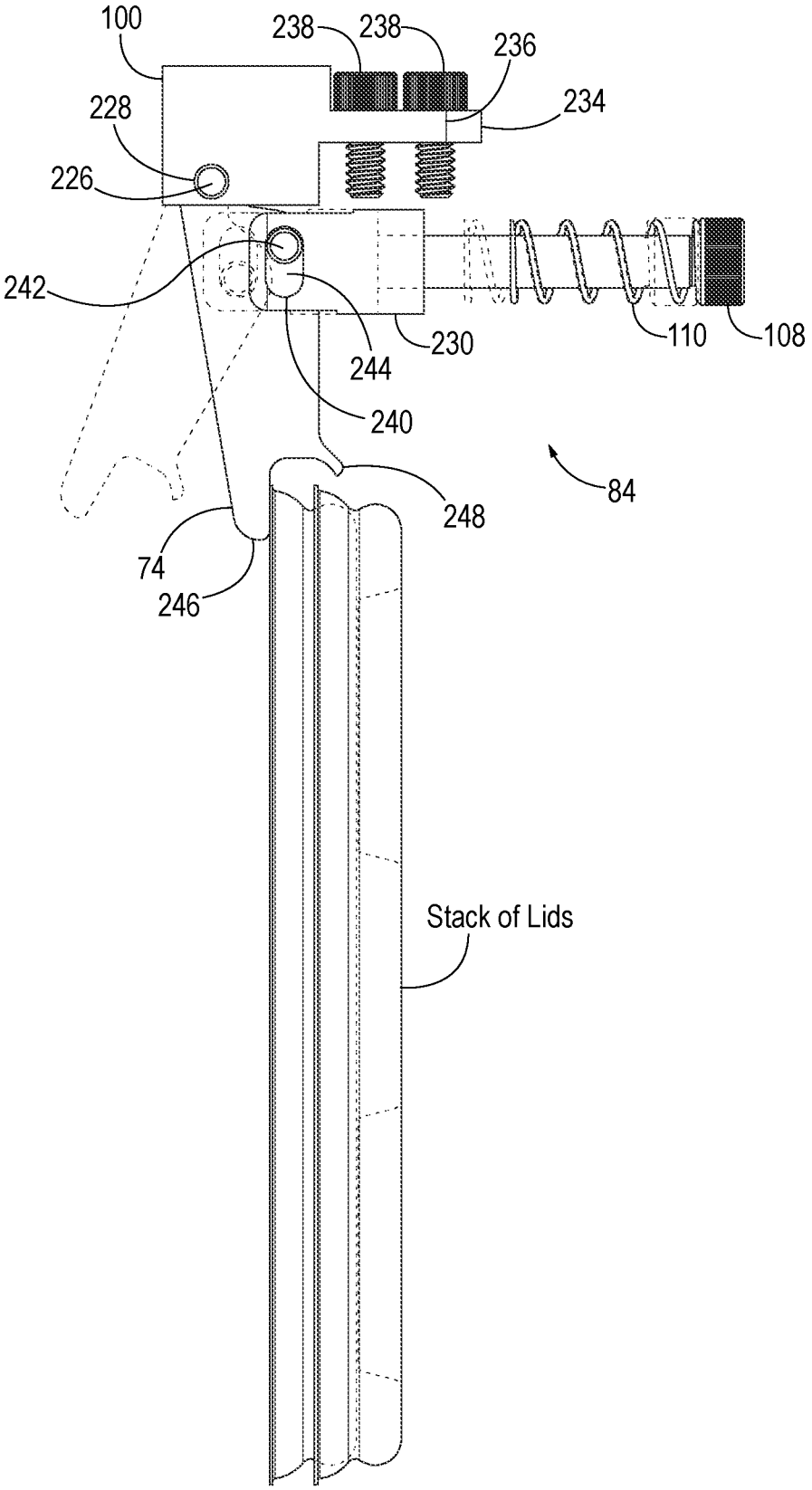

FIG. 21 shows the finger pivot assembly (84). The finger pivot assembly (84) comprises a finger pivot anchor (100). The finger pivot anchor (100) is essentially a rectangular shape that has a protruding boss (234) that has two threaded holes (236) that threadably attach two screws (238). The two screws (238) are used to prevent any dislocation of the finger pivot anchor (100) when activated. The two screws (238) secure the finger pivot assembly (84) in the staging housing (88).

Continuing with FIG. 21, the finger pivot anchor (100) further has an ejecting finger or staging finger (74) that is pivotably attached to through a first hole (228) and has a first press fit pin (226) to allow easy rotation and translate. The finger pivot assemblies (84) further have a shoulder cap screw (108) and a spring (110) attached to a finger drive shaft (230). The finger drive shaft (230) is essentially cylindrical in shape. The finger drive shaft (230) has a top (232) that has a threaded hole (234) to allow the shoulder cap screw (108) to be threadably attached. Towards the bottom of the finger drive shaft (230), a thru slot (240) is provided. The thru slot (240) allows a second press fit pin (242) to be slideably and translatably positioned and secured in a second hole (244) (not shown) in the staging finger (74). The staging finger (74) has a length, where it terminates into a support (246). The support (246) allows beverage lids to rest upon it. The staging finger (74) further has a projection, or thumb (248) that snares the edge of a lid when the finger pivot assembly (84) is activated. As shown by FIG. 21, the dashed lines show that when the main piston (114) has been actuated, it is forced down onto the shoulder cap screw (108), which then forces the finger drive shaft (230) downward, forcing the staging finger (74) to rotate about the first press fit pin (226) and translate and pivot along the thru slot (240) in the finger drive shaft (230). The thumb (248) catches the edge of the beverage lid, and forces it through the thru hole (96) in the staging housing (88) and the thru hole (82) in the staging housing extension (80) and then to be collected in the catch tray (36).

Figure 22:
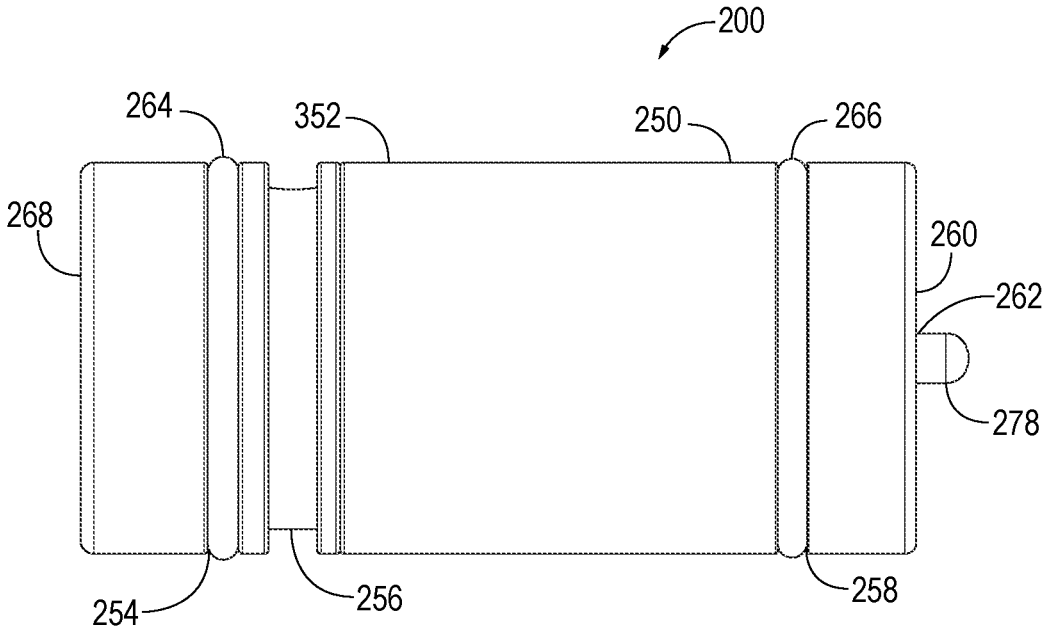

FIG. 22 shows an overall view of the separation pin assembly (200). The separation pin assembly (200) has a separation pin body (250) which has an exterior surface (352), a first groove (254), a second groove (256), and a third groove (258). The separation pin body (250) has a front surface (260), where the front surface (260) of the separation pin body (250) has a central hole (262) that permits the separation pin (278) to separate one beverage lid from the stack of lids. The separation pin assembly (200) has a first O-ring (264) positioned in the first groove (254) and a second O-ring (266) positioned in the third groove (258) in the separation pin body (250).

Figure 23:
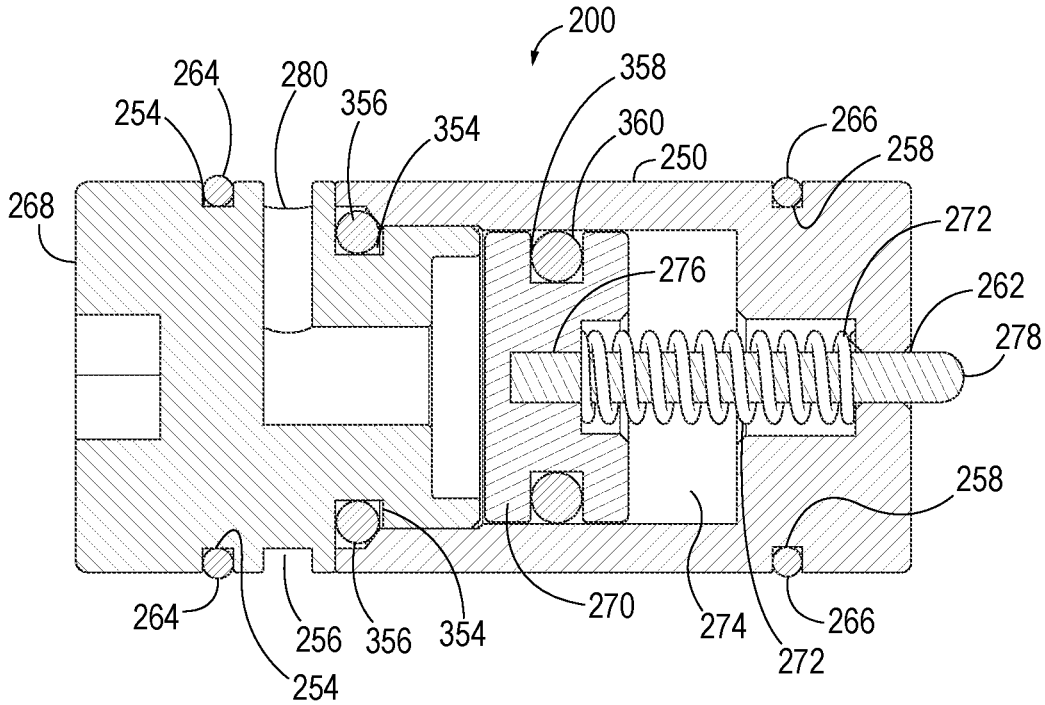

FIG. 23 shows a cross-sectional view of the separation pin assembly (200) showing how the internal components interact. The separation pin body (250) has an internal cavity (274). The internal cavity (274) is sized to allow a separation pin piston (270) to slidably translate through the internal cavity (274). The separation pin piston (270) has provisions to fix the separation pin (278) centrally in the separation pin piston (270). A separation pin spring (or spring) (272) is positioned in a counterbored portion of the separation pin piston (270) and around the separation pin (278). A counterbored recess (276) provides a positional location for the spring (272). A separation pin air-port (or air-port) (280) is provided that communicates with the internal cavity (274) of the separation pin body (250). The air-port (280) in the separation pin body (250) communicates with the first series of air-ports (220) in the staging housing (88) providing compressed air to actuate the separation pin piston (270) and extend the separation pin (278). When the compressed air pressure is reduced, the spring (272) returns the separation pin piston (270) and the separation pin (278) to rest against a separation pin end cap (268). The separation pin end cap (268) is positioned at an end opposing the separation pin (278) and seals the separation pin body (250) to allow the compressed air to actuate the separation pin piston (270). A groove (354) is provided in the separation pin end cap (268) that accommodates an o-ring (356) and is positionally biased towards the separation pin piston (270). In order to prevent any pressure leakage, the separation pin piston (270) has a groove (358) medially positioned on the separation pin piston (270), and accommodates an o-ring (360) positioned within the groove (358). The separation pin end cap (268) may be threadably attached to the separation pin body (250).

Figure 1:
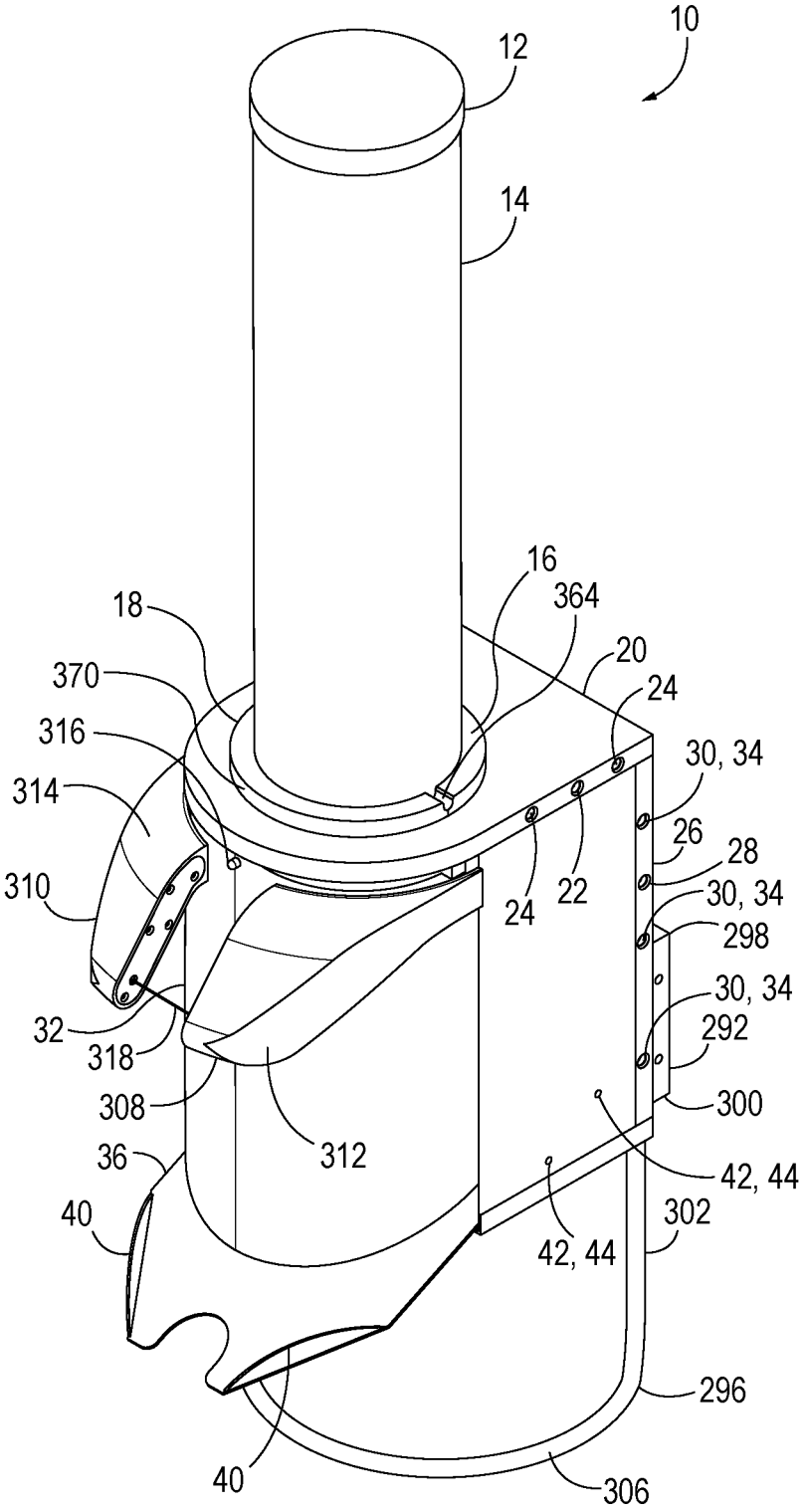
Figure 2:
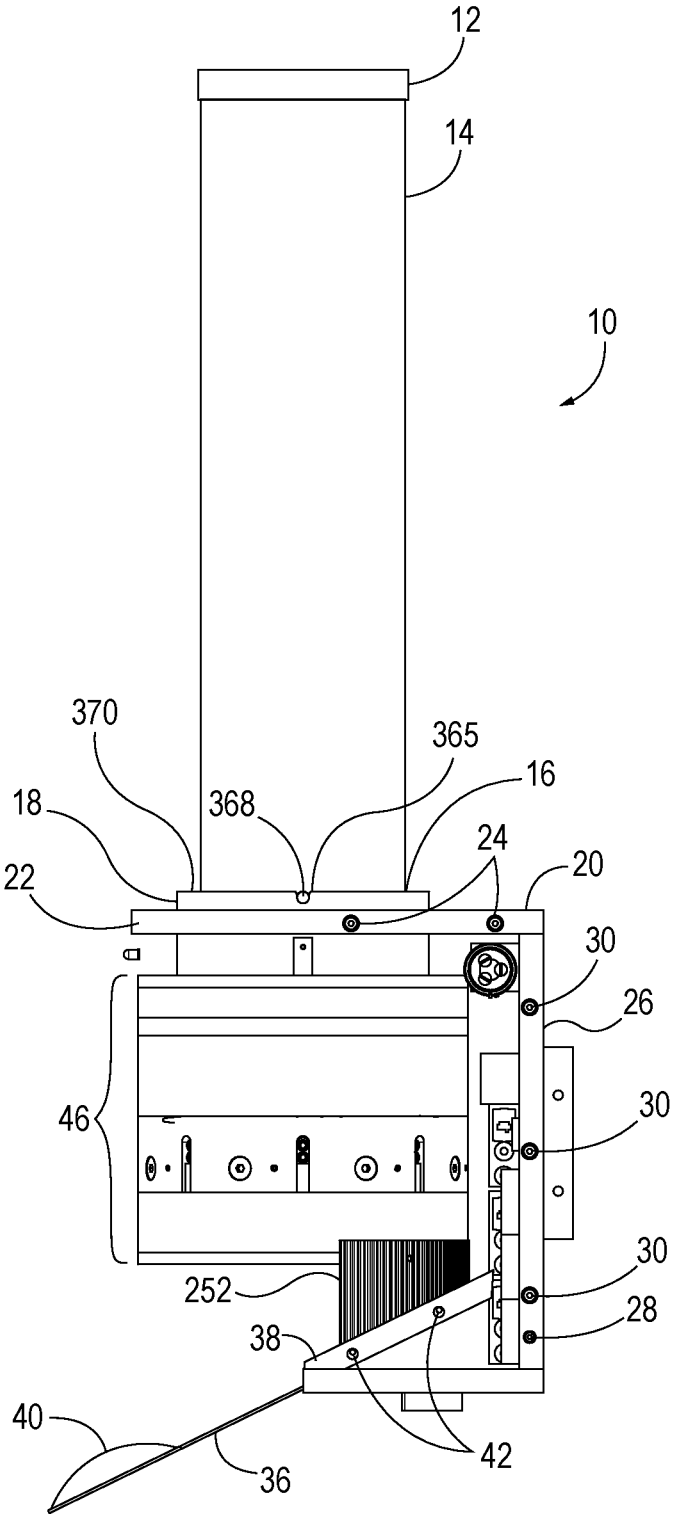
Figure 3:
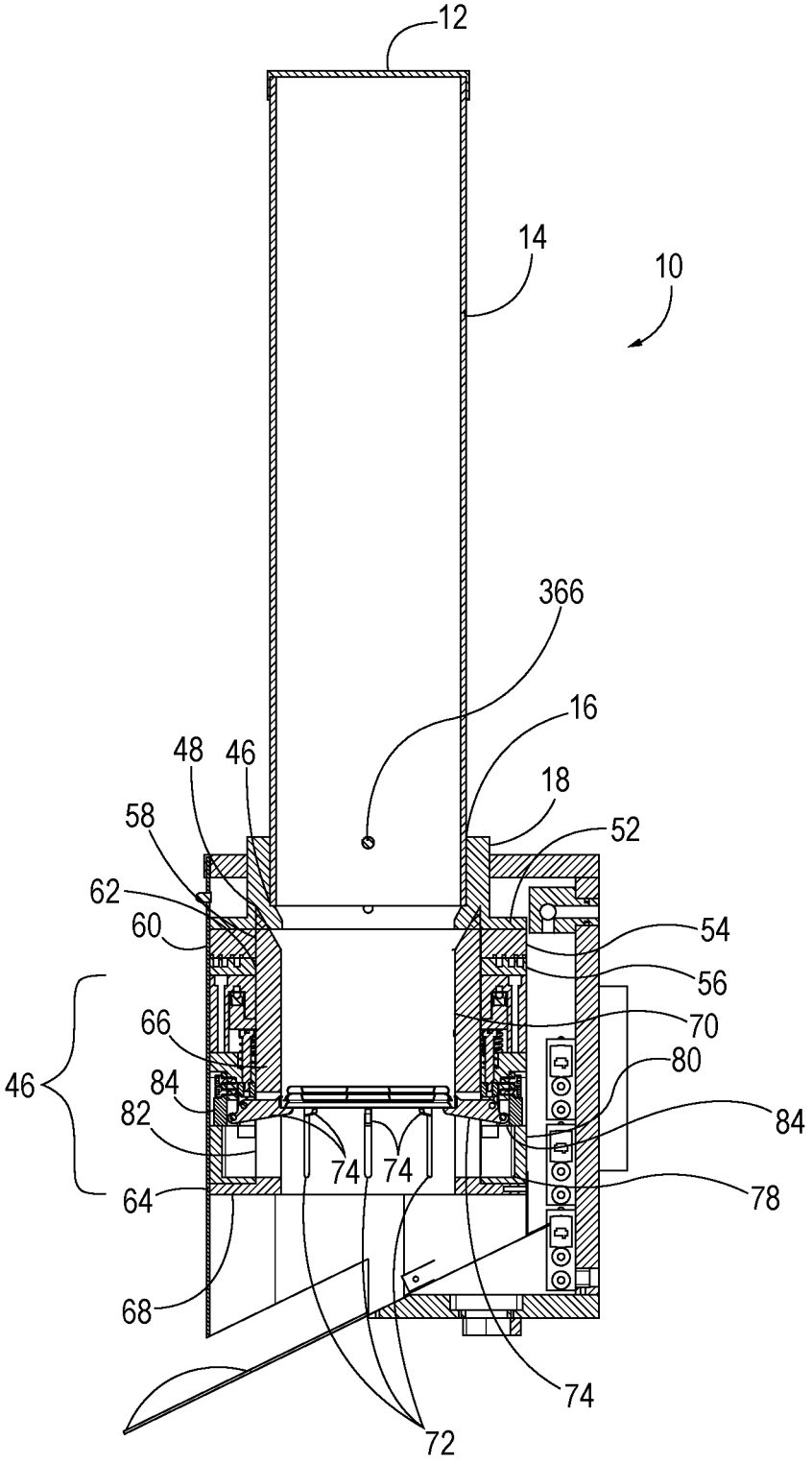
Figure 4:
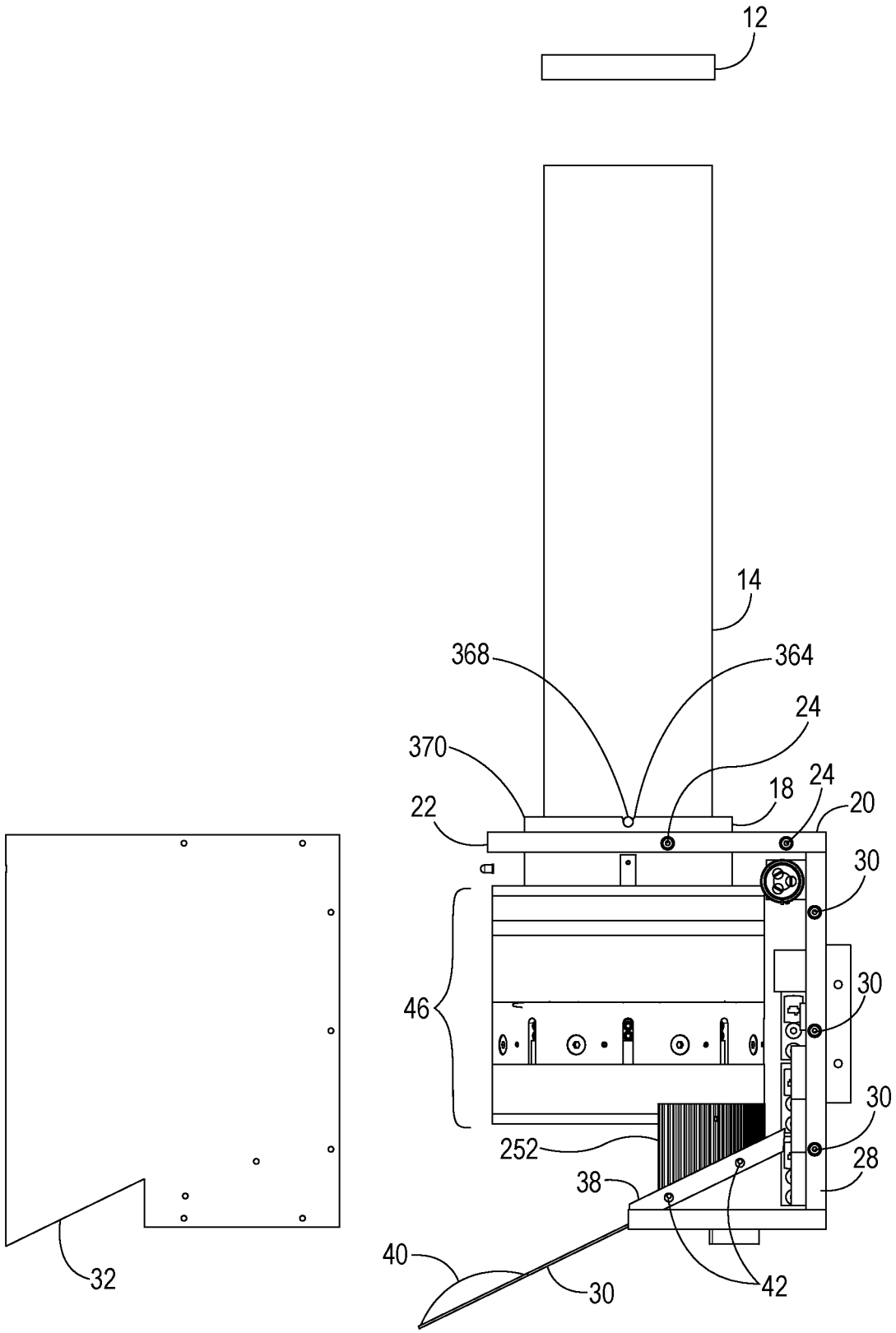
Figure 5:
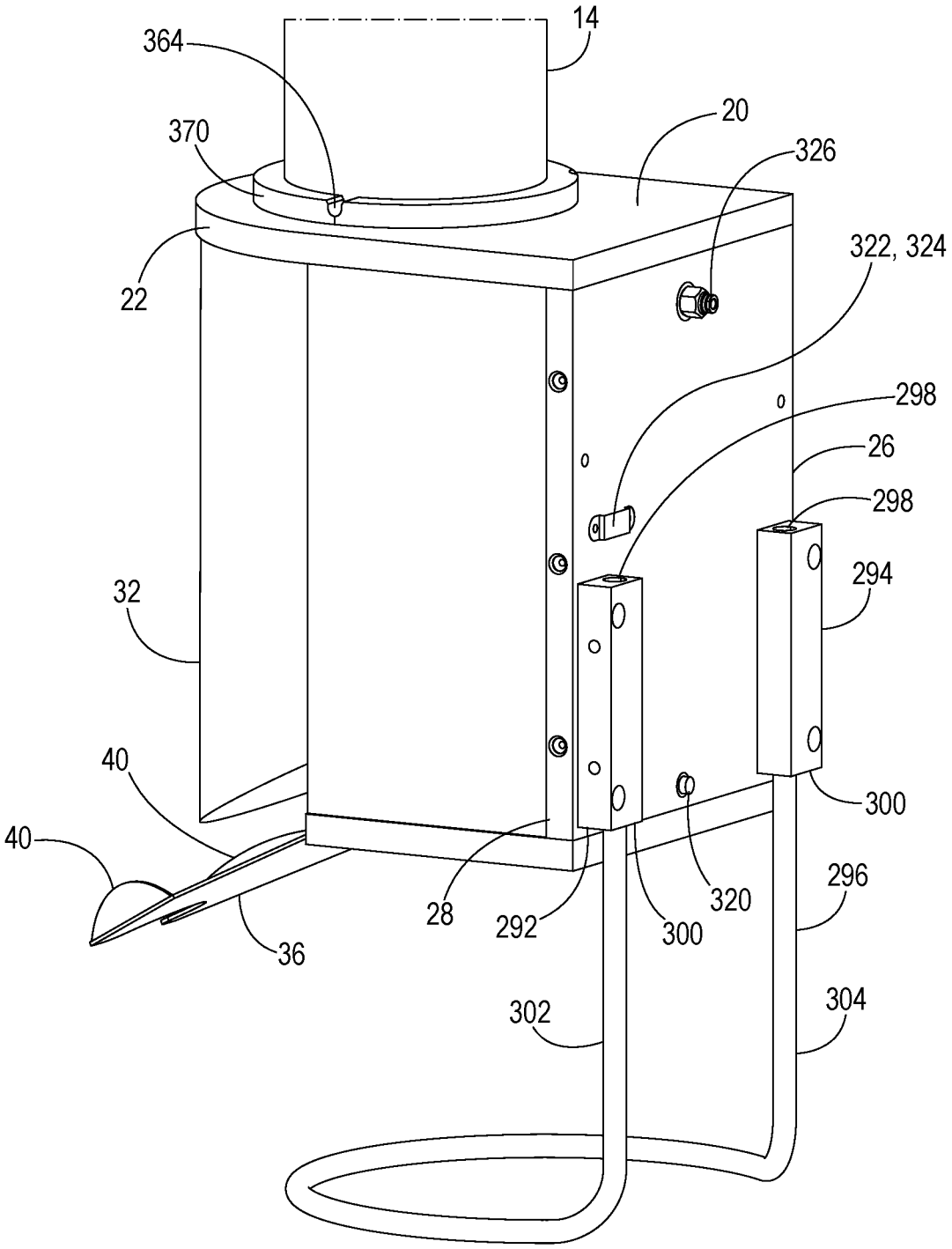
Figure 6:
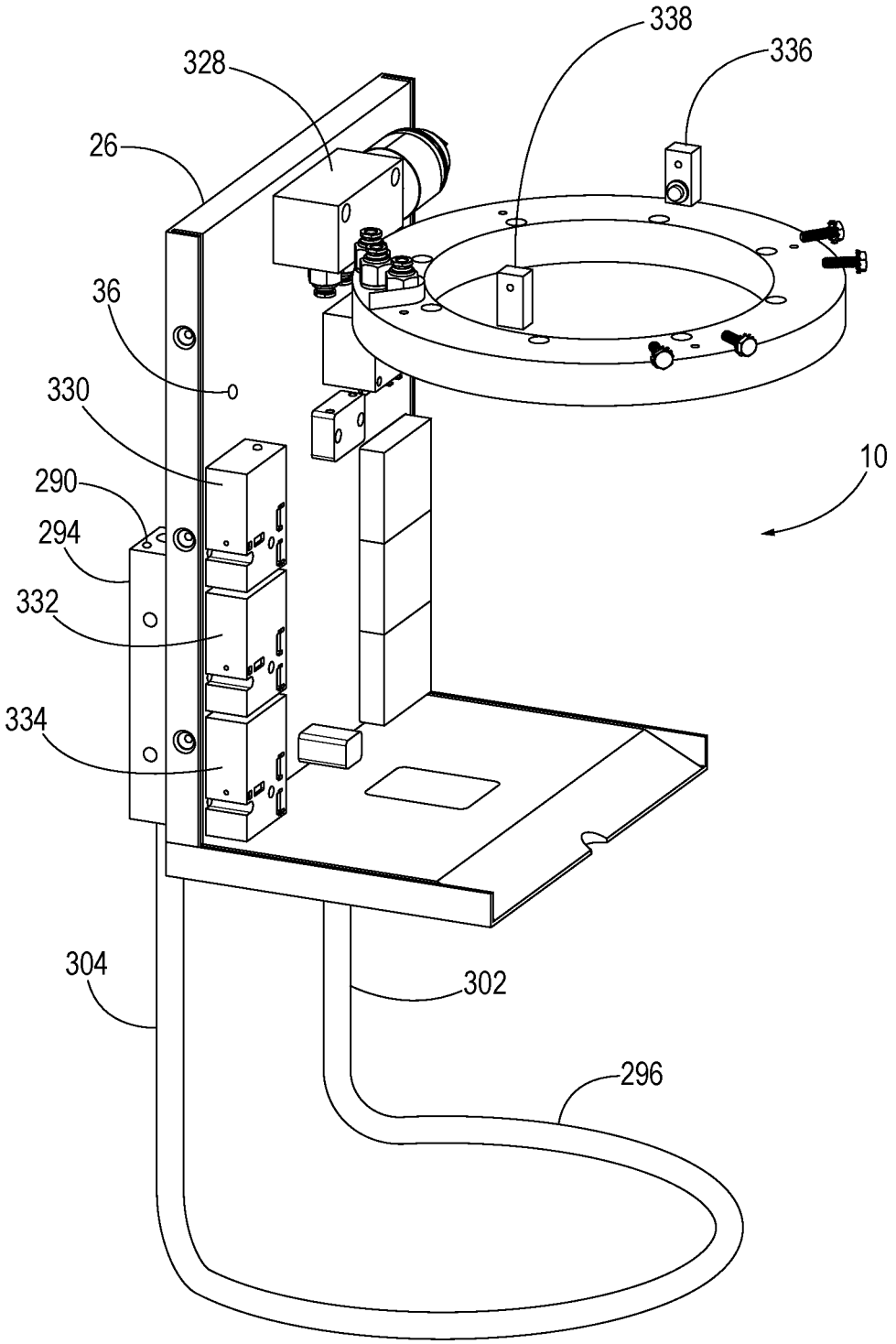
Figure 7:
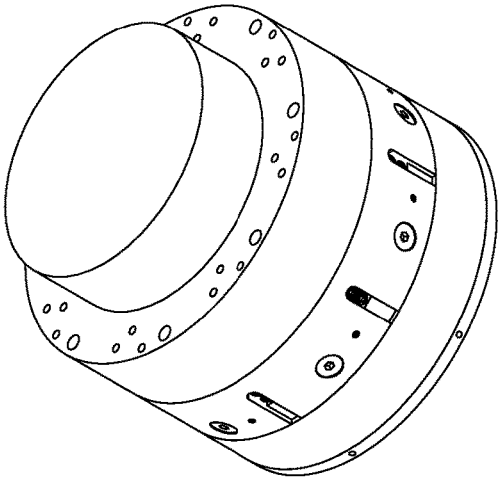
Figure 8:
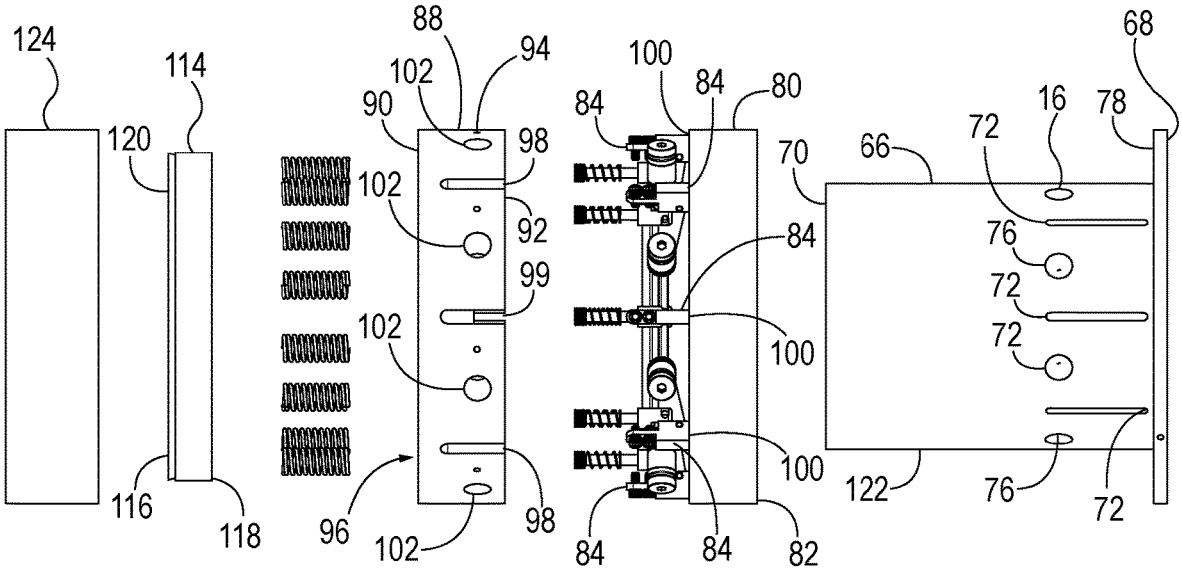
Figure 9:
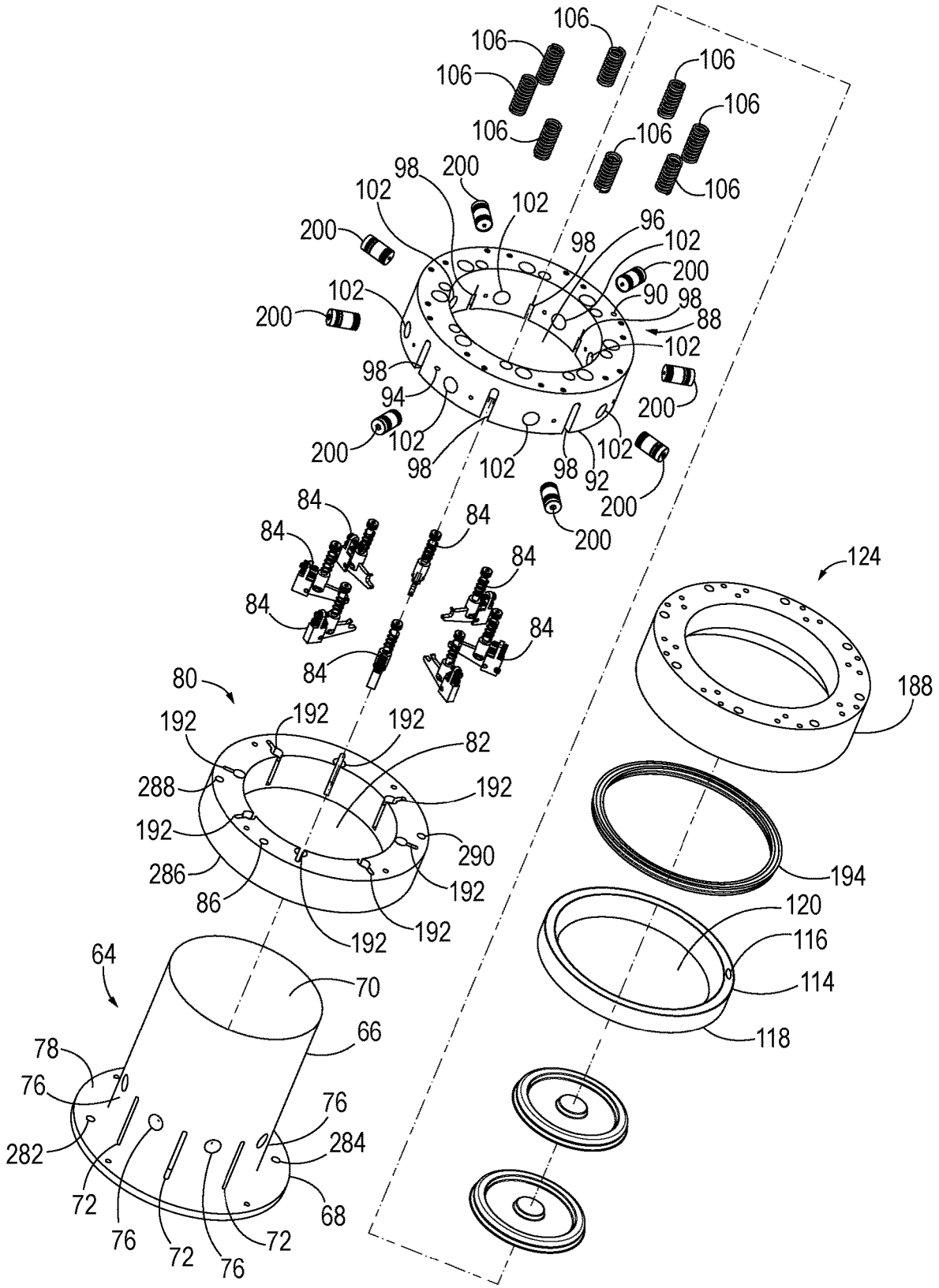

In order to assure correct alignment between the sleeve (64), the staging housing extension (80), and the staging housing (88), a series of clocking holes and clocking pins are added. FIG. 9 shows that the upper surface (78) of the sleeve (64) has a first clocking hole (282) and a second clocking hole (284). The first and second clocking hole (282, 284) are actually counterbores that permit a corresponding first and second clocking pin (not shown) located on the bottom surface (286) of the staging housing extension (80). The top surface (86) of the staging housing extension (80) has a third clocking hole (288) and a fourth clocking hole (290). The third and fourth clocking hole (288, 290) are actually counterbores that permit a corresponding third and fourth clocking pin (not shown) located on the bottom surface (92) of the staging housing (88).

The clocking pins (not shown) and the clocking holes are critical locating features on the sleeve (64), the staging housing extension (80), and the staging housing (88) as they permit complete alignment of the slots (72) in the sleeve (64) to align with the cutouts for the finger assemblies (192) located in the extension housing (80) and the clearance slots (98) located in the staging housing (88) to be aligned and allow the finger pivot assemblies (84) to move without interference. It should also be noted that the thru holes (102) in the extension housing (88) will have concentricity to the separation pin assembly holes (76) located in the sleeve (64) allowing the separation pin assemblies (200) to have direct communication with the thru hole (70) in the sleeve (64). When assembled, the mechanical subassembly (46) slip fits over the sleeve (64) and is aligned with the clocking pins (not shown) and the first and second clocking holes (282, 284).

To further allow for proper airflow from the air source to the respective components, fasteners (not shown) are provided to secure the respective components together.

a. The loading tube flange (18) has a series of four (4) thru holes (374) located on the externally extending flange (50) of the loading tube flange (18).
b. The air manifold cap (54) top surface (52) has a series of four (4) threaded holes (376) that are coordinated with the four thru holes (374) in the loading tube flange (18). The air manifold cap additionally (54) has a series of eight (8) counterbored thru holes (378) that penetrate from the top surface (52) to the bottom side (144) of the air manifold cap (54). The counterbores being deep enough to allow a cap screw (not shown) to be slightly sub-flush to the top surface (52).
c. The air manifold (56) has a series of eight (8) thru holes (380) that penetrate from the top side (56) to the bottom side (176) and communicate with the counterbored thru holes (378) of the air manifold cap (54).
d. The piston bore housing (124) has a series of eight (8) threaded holes (382) that are coaxially positioned common to the eight (8) thru holes (380) in the air manifold (56). Cap screws (not shown) would be inserted into the counterbored thru holes (378) in the air manifold gap (54) and penetrate the eight (8) thru holes (380) in the air manifold (56) and threadably attach in the piston bore housing (124). This secures the air manifold cap (54), the air manifold (56), and the piston bore housing (124) together assuring an airtight seal.

Figure 24:
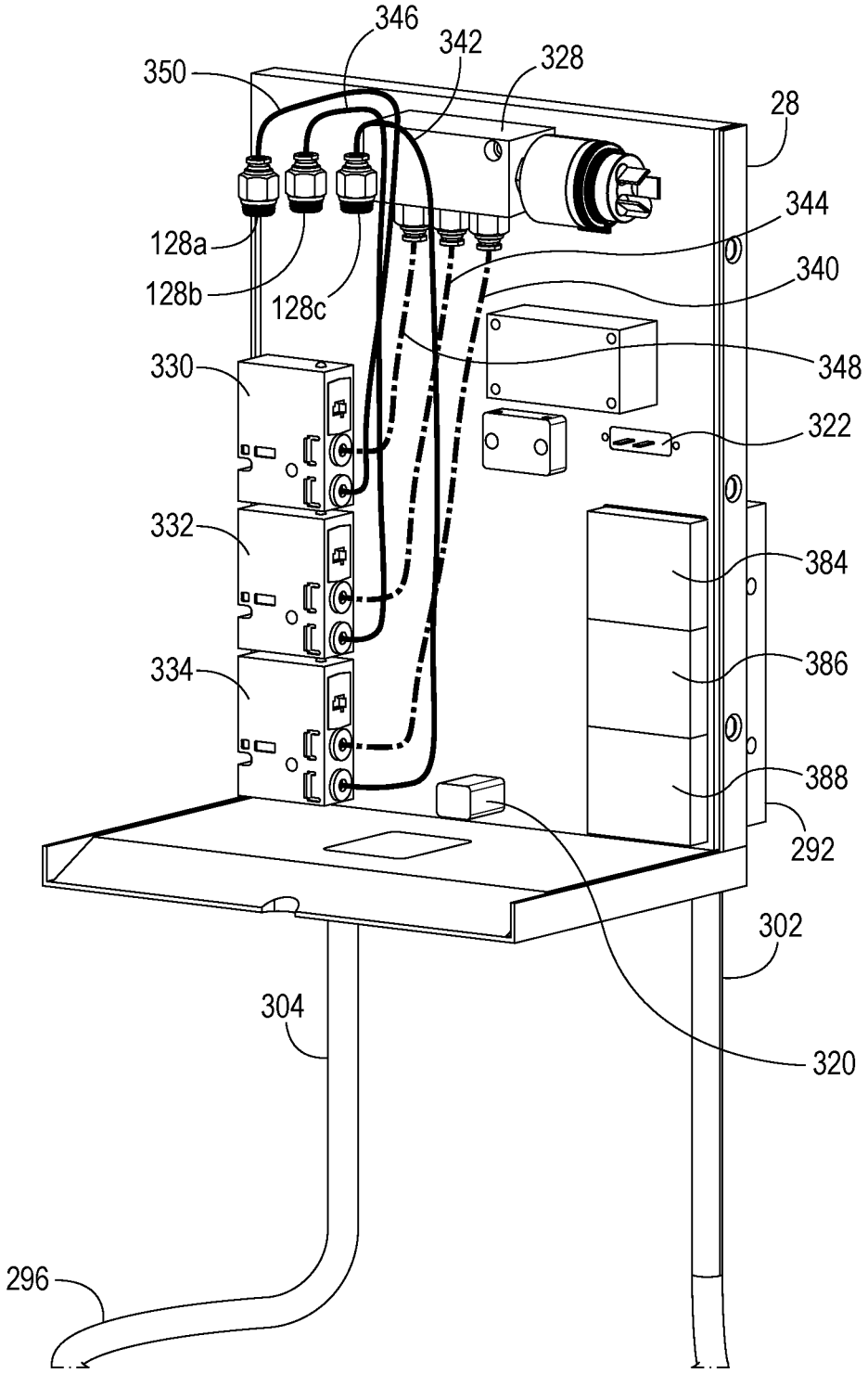

FIG. 24 shows the plumbing between the air manifold (328) and the first second and third solenoids (330, 332, 334), and the first second and third solenoids (330, 332, 334) and the threaded fittings (128). Each of the first second and third solenoids (330, 332, 334) have a pair of air tubes attached as described. The first solenoid (330) has a first input air tube (348) connecting to the air manifold (328) and has a first output air tube (350) connecting the first solenoid (330) to a first air fitting (128A) which provides compressed air to the main piston (114) and activate the finger pivot assemblies (84). The second solenoid (332) has a second input air tube (344) connecting to the air manifold (328) and has a second output air tube (346) connecting to a second air fitting (128B) which provides compressed air to the separation pin assemblies (200). The Third solenoid (334) has a third input air tube (340) connecting to the air manifold (328) and has a third output air tube (342) connecting to a third air fitting (128C) which provides compressed air to "fluff" the lids to assist in dispensing. To assure that the first, second and third solenoids (330, 332, 334) are activated in the correct sequence, a first, second, and third timers (384, 386, 388) are presented. The first solenoid (330) is electrically connected to the first timer (384), the second solenoid (332) is electrically connected to the second timer (386), and the third solenoid (334) is electrically connected to the third timer (388). The first, second, and third timers (384, 386, 388) are mounted onto the component mounting board (390) and is provided power by the power supply input (320).

An alternative method to dispense the lids would be the use of electro-mechanical devices which would replace the air system in the dispenser.

Although the present invention has been described with reference to the disclosed embodiments, numerous modifications and variations can be made and still the result will come within the scope of the invention. No limitation with respect to the specific embodiments disclosed herein is intended or should be inferred. Each component of the apparatus' embodiment described herein has numerous equivalents that may be used to provide the same scope as the invention.

What is claimed is:

1. A sanitary hands-free lid dispenser comprising:

a. a loading tube having a cylindrical shape, the loading tube having a cap attached on one end thereon, at an opposing end to the cap, the loading tube has a pair of thru holes defined therein, the thru holes are adapted to allow a circular rod to be slidably inserted and removed, the pair of thru holes are located so as to not support the loading tube when the loading tube is resting on a ledge of a loading tube flange;

b. the loading tube flange has a central hole defined therein, the central hole being adapted to mount the loading tube with a ledge of the loading tube flange, and being adapted to slideably fit on an outer surface of a centrally positioned cylinder, the centrally positioned cylinder is a component of a sleeve;

c. a mechanical subassembly, which includes the sleeve, the mechanical subassembly comprising an air intake means and an air distribution means, the air distribution means comprising a first, a second and a third threaded fitting, the first threaded fitting communicating with an air piston, the second threaded fitting communicating with a series of separation pin assemblies, and a third threaded fitting providing compressed air to "fluff" the beverage lids;

d. the air intake means comprises an air manifold, the air manifold providing compressed air to a first solenoid with a first air import tube, a second solenoid with a second air import tube, and a third solenoid with a third air import tube, the first solenoid providing compressed air to the first threaded fitting with a first air output tube, the second solenoid providing compressed air to the second threaded fitting with a second air output tube, and the third solenoid providing compressed air to the third threaded fitting with a third air output tube;

e. an end cover having forward facing flanges, a top cover, the top cover having down turned flanges, a catch tray, the catch tray having upturned flanges and upturned end flanges, a front skin, and a splash guard, the downturned flanges of the top cover having holes defined therein, the holes coordinated with holes defined in a front skin, the forward-facing flanges of the end cover having holes defined therein, the holes coordinated with holes in the front skin, the upturned end flanges of the catch tray having at least two holes on each flange defined therein, the holes coordinated with holes in the front skin, the catch tray is positioned with a slope, the component mounting board is attached onto the end cover;

f. the hands-free lid dispenser further has a first sensor and a second sensor, the first sensor has a first sensor housing and the second sensor has a second sensor housing, the first sensor housing and the second sensor housing are positioned opposing each other and fastened onto the front skin of the hands-free lid dispenser, the first and second sensor are aligned and provide a cycle trip beam that when interrupted by an opaque object, activates the mechanism to dispense a lid into the catch tray, the hands-free sanitary lid dispenser is provided with a low product indicator that when tripped, visually indicates to the users that the loading tube needs refilling with beverage lids; and g. a hands free dispenser stand, the hands free dispenser stand supporting the lid dispenser, the hands free dispenser stand comprising a first vertical portion and a second vertical portion, the first and second vertical portions being inserted into a first support bracket and a second support bracket, the first and second support brackets having holes defined therein to allow the first and second vertical portions to be inserted therein, the first and second support brackets being attached onto the end cover, the first and second vertical portions meet at a base of the hands free dispenser stand supporting the device thereby.

2. The sanitary hands-free lid dispenser of claim 1, wherein the mechanical subassembly comprises:

a. the loading tube flange, the loading tube flange having an externally extending flange and is placed on a top surface of an air manifold cap, the air manifold cap being placed on a top surface of an air manifold, the air manifold being placed on a top surface of a piston bore housing, the piston bore housing has a circular cavity defined therein to allow a main piston to slideably translate therein;

b. the main piston housing is placed on a top surface of a staging housing, the top surface of the staging housing having a series of eight (8) counterbores defined therein, the counterbores being adapted to secure a series of eight (8) piston springs, where the counterbores provided have a depth that allows the piston springs to have a slip fit and therefore allow the piston springs to protrude above the top surface of the staging housing, the staging housing is placed upon a top surface of a staging housing extension, the staging housing extension is placed on a top surface of an outward extending flange of the sleeve;

c. the top surface of the outward extending flange of the sleeve has a first clocking hole and a second clocking hole defined therein, the first clocking hole and second clocking holes permit a corresponding first and a corresponding second clocking pin, the first and second clocking pins extend from a bottom surface of the staging housing extension positionally locking the extension housing extension to the sleeve;

d. a top surface of the staging housing extension has a third clocking hole and a fourth clocking hole defined therein, the third and fourth clocking holes permit a corresponding third clocking pin and a corresponding fourth clocking pin to be positioned and located on a bottom surface of the staging housing;

e. the centrally positioned cylinder located on the flange has a series of separation pin assembly holes defined therein, the separation pin assembly holes are interspaced and equally circumferentially positioned, the staging housing has a series of thru holes defined therein, and are positionally in line with the separation pin assembly holes in the flange, the staging housing has an exterior surface, and a thru hole defined therein, the separation pin assembly holes penetrate from the exterior surface thru to the central hole of the staging housing, and slideably allow a separation pin assembly to be inserted therein, the centrally positioned cylinder additionally has a series of slots defined therein, the slots being interspaced equally between the separation pin assembly thru holes in the centrally positioned cylinder; and f. the staging housing has series of clearance slots defined therein which are provided to allow the staging housing to be mounted onto the top surface of the staging housing extension, the clearance slots penetrate from the exterior surface to the through hole of the staging housing, the clearance slots are stepped to provide adequate clearance to a finger pivot anchor which is part of a series of finger pivot assemblies, the finger pivot assemblies being secured on a flange located in the clearance slots and allow the finger pivot to rotate therethrough.

3. The sanitary hands-free lid dispenser of claim 2, wherein the finger pivot assembly comprises a finger pivot anchor, the finger pivot anchor is essentially a rectangular shape that has a protruding boss that has two threaded holes defined therein, the two threaded holes threadably attach two screws that prevent any dislocation of the finger pivot anchor when activated the two screws secure the finger pivot assembly in the staging housing, the ejecting finger or staging finger is pivotably attached to a staging housing that has a first hole defined therein, a first press fit pin is inserted thru the staging housing and staging finger and allows for rotation and translation, the finger pivot assemblies further have an shoulder cap screw and a spring attached to a finger drive shaft, the finger drive shaft is essentially cylindrical in shape, and has a top that has a threaded hole defined therein which allows the shoulder cap screw to be threadably attached, towards the bottom of the finger drive shaft a thru slot is provided, the thru slot allows a second press fit pin to be slideably and translatably positioned and secured in a second hole in the staging finger, the staging finger has a length which terminates into a support, the support allows beverage lids to rest thereupon, the staging finger further has a projection, or thumb that snares the edge of a lid when the finger pivot assembly is activated.

4. The sanitary hands-free lid dispenser of claim 2, wherein:

a. the separation pin assembly comprises a separation pin body, the separation pin body has an exterior surface, a first groove, a second groove, and a third groove defined therein, the separation pin body further has a front surface, where the front surface of the separation pin body has a central hole defined therein that permits a separation pin to separate one beverage lid from the stack of lids, the separation pin assembly has a first O-ring positioned in the first groove and a second O-ring positioned in the third groove of the separation pin body;

b. the separation pin body has an internal cavity defined therein, the internal cavity is sized to allow a separation pin piston to slidably translate through the internal cavity, the separation pin piston has provisions to fix the separation pin centrally in the separation pin piston, the separation pin piston has counterbored portion defined therein and allows a separation pin spring (or spring) to be positioned in and around the separation pin;

c. a counterbored recess provides a positional location for the spring, the separation pin body further has a separation pin air-port (or air-port) defined therein, the air-port communicates with the internal cavity of the separation pin body;

d. the air-port in the separation pin body communicates with the third threaded fitting providing compressed air to actuate the separation pin piston and extend the separation pin, reducing the air pressure causes the spring to return the separation pin piston and the separation pin to rest against a separation pin end cap; and e. the separation pin end cap is positioned at an end opposing the separation pin and seals the separation pin body allowing the compressed air to actuate the separation pin piston, a groove is provided in the separation pin end cap that accommodates an o-ring and is positionally biased towards the separation pin piston pressure leakage is prevented by, the separation pin piston having a groove medially positioned on the separation pin piston thereby accommodating an o-ring that is positioned within the groove, the separation pin end cap is threadably attached to the separation pin body, the separation pin assemblies being slideably inserted onto the separation pin assembly holes allowing the first series of air-ports to communicate with the air-port in the separation pin assembly.

5. The sanitary hands-free lid dispenser of claim 2, wherein the loading tube flange is defined as a "L" shaped cylinder of revolution that has a centrally located cylindrical hole defined therein that is adapted to slideably fit on the outer surface of the centrally positioned cylinder of the sleeve and has an upstanding leg where a semi-circular trim is defined and provides clearance to the circular rod that is used to temporarily secure the beverage lids when they are in the loading tube.

6. The sanitary hands-free lid dispenser of claim 2, wherein:

a. the air manifold cap is defined as a cylinder of revolution, and has a central hole defined therein that is adapted to slideably fit on the outer surface of the centrally positioned cylinder of the sleeve, the air manifold cap top surface has a first threaded hole, a second threaded hole, and a third threaded hole defined therein, the first, second and third threaded holes have the threaded fittings each threaded into the first, second and third threaded holes, the air manifold cap has a bottom side, the bottom side of the manifold cap has a first groove, a second groove, a third groove, and a fourth groove defined therein allowing a first o-ring, a second o-ring, a third o-ring, and a fourth o-ring to be positioned therein, the bottom side of the air manifold cap further has a first airhole, a second airhole, and a third airhole, where the first, second, and third airholes communicate with the first second and third threaded holes respectfully in the air manifold cap.

7. The sanitary hands-free lid dispenser of claim 2, wherein:

a. the air manifold is defined as a cylinder of revolution and has a central hole defined therein that is adapted to slideably fit on the outer surface of the centrally positioned cylinder of the sleeve, the air manifold top side has a first ledge, a second ledge, a third ledge, and a fourth ledge defined thereon creating a first groove, a second groove, and a third groove thereby, the first, second, third, and fourth ledge provides a flat surface for the first, second, third, and fourth o-rings of the air manifold cap to compress against and thereby provide a full seal for pressurized air to be transmitted fully to the first, second, and third grooves defined in the air manifold, the first groove in the air manifold aligns with the first airhole in the air manifold cap, the second groove in the air manifold aligns with the second airhole in the air manifold cap, and the third groove in the air manifold aligns with the third airhole in the air manifold cap;

b. the air manifold has bottom side where the bottom side has a first series of eight (8) air holes defined therein, the first series of airholes are used to actuate the main piston, the first series of airholes are concentrically located within the third groove in the air manifold, the bottom side has a second series of eight (8) air holes defined therein, the second series of airholes are concentrically located, within the second groove of the air manifold, the second series of air holes provide compressed air to actuate the separation pin assemblies, the bottom side has a third series of air holes defined therein, the third series of airholes are concentrically located within the first groove of the air manifold, where the third series of air holes provides air to "fluff" cup lids for assisting in separating the lowermost lid from the stack of beverage lids.

8. The sanitary hands-free lid dispenser of claim 2, wherein:

a. a piston bore housing, the piston bore housing is defined as a modified "C" shaped cylinder of revolution having an internal gap defined therein, the internal gap houses the main piston, the piston bore housing has a bottom surface, and a central hole defined therein that is adapted to slideably fit on the outer surface of the centrally positioned cylinder of the sleeve where the central hole and allows a stack of beverage lids to be positioned therein, the top surface of the piston bore housing has a first series of eight (8) air thru holes defined therein, the series of air thru holes are located on the top surface of the piston bore housing and provide pressurized air to activate the main piston, the top surface further has a second series of air thru holes defined therein and are concentrically located and positioned on the top surface of the piston bore housing where the second series of air thru holes provide pressurized air to activate the separation pin assemblies, the top surface of the piston bore housing has a third series of air thru holes defined therein and are concentrically located and positioned, the third series of air thru holes provide pressurized air to fluff the beverage lids, the second and third series of air thru holes penetrate the top and bottom surfaces of the piston bore housing, the first, second and third series of air thru holes located on the top surface of the piston bore housing are slightly counterbored to provide accommodation for a first, second and third series of o-rings, the first second and third series of o-rings are placed therein providing a seal between the main piston bore housing and the bottom side of the air manifold;

b. the bottom surface of the piston bore housing has an external flange and an internal flange defined therein, the external flange has an outer surface, and the internal flange has an inner surface, the outer surface of the external flange aligns with an exterior surface of the staging housing, the inner surface of the piston bore housing is slidably adapted to fit over the centrally positioned cylinder of the sleeve, the piston bore housing defines a gap between the external flange and the internal flange, thereby allowing the piston to slidably translate within the gap; and c. the bottom surface of the piston bore housing further has the first series of air thru holes defined therethrough, where the first series of air thru holes are concentrically located and positioned within the gap between the external flange and the internal flange, the second series of air thru holes exit the bottom surface and are concentrically located and positioned on the bottom surface of the piston bore housing, the bottom surface further has the third series of air thru holes that are concentrically located and positioned exiting the bottom surface of the piston bore housing.

9. The sanitary hands-free lid dispenser of claim 8, wherein:

a. the main piston is a "L" shaped cylinder of revolution and has a top surface, a bottom surface and a thru hole defined therein, the thru hole is adapted to slidably move along the outer surface of the piston bore housing, the main piston has a top surface and a thru hole defined therein, an outer surface of the main piston would slideably bear against an inner surface of the external flange of the piston bore housing, a main piston seal is adhered to the main piston and is u-shaped, where a base of the main piston seal is adhered to the top surface of the main piston, the main piston seal bears against the inner surface and an external surface defined by the gap in the main piston seal, the bottom surface of the main piston has a plurality of counterbores defined therein, the plurality of counterbores provide positional location and recesses for the main piston and for the piston springs.

10. The sanitary hands-free lid dispenser of claim 2, wherein:

a. the staging housing is defined as a cylinder of revolution and has a thru-hole defined therein that is adapted to slideably fit on the outer surface of the centrally positioned cylinder of the sleeve, the top surface of the staging housing has a first series of air-ports defined therein and where a first series of air-ports are aligned with and directly communicate with the second series of thru-holes located in the piston bore housing, the first series of air-ports penetrating therethrough and allow compressed air to communicate with the series of thru-holes located in the staging housing providing compressed air to actuate the plurality of separation pin assemblies, a second series of air-ports is shown on the top surface of the staging housing where the second series of air-ports penetrate through the top surface of the staging housing and exit into the thru-hole via a plurality of exit ports, the first series of air-ports are slightly counterbored and accommodate a first series of o-rings, the second series of air-ports are slightly counterbored to accommodate a second series of o-rings, the first and second o-rings seal the top surface of the main piston housing to the top surface of the staging housing.

11. The sanitary hands-free lid dispenser of claim 2, wherein:

a. the staging housing extension is defined as a cylinder of revolution and has a central hole defined therein, the staging housing extension has cutouts defined therein, the cutouts provide clearance allowing the ejecting finger to easily rotate and translate, the finger pivot assemblies are situated to allow each ejecting finger to pass through the slots located in the sleeve.

12. The sanitary hands-free lid dispenser of claim 2, wherein:

a. the sleeve is defined having a "L" shaped cross section cylinder of revolution where the centrally positioned cylinder, has a thru hole defined therein, the outward extending flange, the sleeve has a central through hole defined therein b. a series of eight (8) of slots are situated around the centrally positioned cylinder, the slots allowing an ejecting finger to pivot through, the polarity of slots extend through the through hole, the plurality of slots are equally circumferentially positioned, interspaced and equally circumferentially located between the plurality of slots are separation pin assembly holes.

13. The sanitary hands-free lid dispenser of claim 2, wherein:

a. the component mounting board has the first, second, and third solenoid attached to the component mounting board, the first and second solenoids are three-way solenoids, the third solenoid is a two-way solenoid;

b. an air manifold is provided and is centrally positioned towards a top portion of the component mounting board, the air solenoid providing pressurized air to each solenoid;

c. a fuse and connector or input is located towards a bottom of the end cover and provides between 5 volts and 24 volts to the electrical system, a fuse and cover are shown positioned towards a middle portion of the end cover, a first timer, a second timer and a third timer are provided, where the first second and third timers are electrically connected to the first, second and third solenoids respectfully and sequentially actuate the first, second and third solenoids; and d. towards a middle top of the end cover an input supply air fitting is provided, input pressure should be between 30 psi and 35 psi, the input supply air fitting communicates with the air manifold which supplies pressurized air to the first solenoid, the second solenoid, and the third solenoid.

14. The sanitary hands-free lid dispenser of claim 2, wherein:

a. the loading tube flange has a series of four (4) thru holes defined on the externally extending flange of the loading tube flange;

b. the top side of the air manifold has a series of eight (8) thru holes defined therein that penetrate from the top side to the bottom side and communicate with the counterbored thru holes of the air manifold cap;

c. the piston bore housing has a series of eight (8) threaded holes defined therein that are coaxially positioned and common to the eight (8) thru holes in the air manifold, cap screws would be inserted into the counterbored thru holes in the air manifold gap and penetrate the eight (8) thru holes in the air manifold and threadably attach in the piston bore housing, this secures the air manifold cap, the air manifold, and the piston bore housing together assuring an airtight seal.

15. A sanitary hands-free lid dispenser comprising:

a. a loading tube, a cap, a flange, a mechanical subassembly, and an end cover, the end cover having forward facing flanges, a top cover, the top cover having down turned flanges, a catch tray, the catch tray having upturned flanges and upturned end flanges, a front skin, and a splash guard;

b. the downturned flanges of the top cover having holes defined therein, the at least two holes coordinated with holes in the front skin, the forward-facing flanges of the end cover having holes defined therein, the holes coordinated with holes in the front skin, the upturned end flanges of the catch tray having at least two holes on each flange defined therein, the holes coordinated with holes in the front skin;

c. the hands-free lid dispenser further has a first sensor and a second sensor, the first sensor has a first sensor housing and the second sensor has a second sensor housing, the first sensor housing and the second sensor housing are positioned opposing each other and fastened onto the front skin of the hands-free lid dispenser, the first and second sensor are aligned and provide a cycle trip beam that when interrupted by an opaque object, activates the mechanism to dispense a single lid into the catch tray, the hands-free sanitary lid dispenser is provided with a low product indicator that when tripped, visually indicates to the users that the loading tube needs refilling with beverage lids;

d. the catch tray is positioned with a slope allowing a beverage lid to slide towards an end where the end flanges, are angled towards each other, stop the movement of the beverage cup lid, the upturned flanges of the catch tray:

e. the loading tube being circular in shape and the cap being fixed to the loading tube at one end, the loading tube fitting into a loading tube flange, the loading tube flange having a cylindrical hole that is adapted to fit the loading tube, the loading tube flange having a ledge to seat the loading tube;

f. the loading tube flange is defined as a "L" shaped cylinder of revolution that has a centrally located cylindrical hole defined therein, the loading tube flange has an externally extending flange that rests upon a mechanical subassembly;

g. the mechanical subassembly comprises an air manifold cap, an air manifold, a piston bore housing containing a main piston with a main piston seal, a staging housing, a staging housing extension, and the sleeve;

h. the loading tube flange is trimmed to provide clearance to threaded fittings, where the threaded fittings have been threadably inserted into an air manifold cap;

i. the air manifold cap is defined as a cylinder of revolution, and has a central hole defined therein, the air manifold cap has a top surface that has a first threaded hole, a second threaded hole, and a third threaded hole defined therein, the first, second and third threaded holes have the threaded fittings each threaded into the first, second and third threaded holes, the air manifold cap has a bottom side that has a first groove, a second groove, a third groove, and a fourth groove defined therein which allow a first o-ring, a second o-ring, a third o-ring, and a fourth o-ring to be positioned therein, the bottom side of the air manifold cap has a first airhole, a second airhole, and a third airhole, where the first, second, and third airholes communicate with the first second and third threaded holes respectfully in the air manifold cap, the bottom side of the air manifold cap is positioned on a top side of an air manifold;

j. the air manifold is defined as a cylinder of revolution and has a central hole defined therein, the air manifold further has a top side, the top side of the air manifold has a first ledge, a second ledge, a third ledge, and a fourth ledge defined thereon creating a first groove, a second groove, and a third groove, thereby, the first, second, third, and fourth ledge provides a flat surface for the first, second, third, and fourth o-rings to compress against and thereby provide a full seal for pressurized air to be transmitted fully to the first, second, and third grooves defined in the air manifold, the first groove in the air manifold aligns with the first airhole in the air manifold cap, the second groove in the air manifold aligns with the second airhole in the air manifold cap, and the third groove in the air manifold aligns with the third airhole in the air manifold cap, the air manifold has bottom side where the bottom side has a first series of air holes defined therein, where the first series of airholes are used to actuate a main piston, the first series of airholes are concentrically located within the third groove in the air manifold, a second series of air holes is concentrically positioned and defined within the second groove of the air manifold, the second series of air holes provide compressed air to actuate a plurality of separation pin assemblies, a third series of air holes is concentrically positioned and defined within the first groove of the air manifold, where the third series of air holes provides air to "fluff" a singular cup lid for separation;

k. a piston bore housing, the piston bore housing is defined as a modified "C" shaped cylinder of revolution having an internal gap defined therein, the internal gap houses the main piston, the piston bore housing has a top surface, a bottom surface, and a central hole defined therein where the central hole shown allows a stack of beverage lids to be positioned therein, the piston bore housing has a first series of air thru holes defined therein, the first series of air thru holes is located on the top surface of the piston bore housing and provides pressurized air to activate the main piston, a second series of air thru holes are concentrically located and positioned on the top surface of the piston bore housing, where the second series of air thru holes provide pressurized air to activate the plurality of separation pin assemblies, a third series of air thru holes are concentrically located and positioned on the top surface of the piston bore housing, the third series of air thru holes provide pressurized air to fluff a singular beverage lid, the second and third series of air thru holes penetrate the top and bottom surfaces of the piston bore housing the first, second, and third air thru holes are slightly counterbored on the top surface of the main piston bore housing and accommodate a series of first, second and third o-rings providing a seal between the air manifold and the piston bore housing;

l. The bottom of the piston bore housing has an external flange and an internal flange defined therein, where the external flange has an outer surface, and the internal flange has an inner surface, the outer surface of the external flange aligns with an exterior surface of a staging housing, the inner surface of the piston bore housing is slidably adapted to fit over a centrally positioned cylinder of a sleeve, the piston bore housing defines a gap between the external flange and the internal flange, thereby allowing the piston to slidably translate within the gap;

m. the bottom surface of the piston bore housing shows the first series of air thru holes, where the first series of air thru holes are concentrically located and positioned within the gap between the external flange and the internal flange, the first series of air thru holes provide pressurized air to activate the main piston, the second series of air thru holes are shown and are concentrically located and positioned on the bottom surface of the piston bore housing, the second series of air thru holes provide pressurized air to activate the separation pin assemblies, a third series of air thru holes are concentrically located and positioned on the bottom surface of the piston bore housing, the third series of air thru holes provide pressurized air to fluff the beverage lids, the bottom surface of the piston bore housing rests against a top surface of a staging housing;

n. the main piston is a "L" shaped cylinder of revolution and has a top surface a bottom surface, and a thru hole defined therein, the thru hole is adapted to slidably move along the outer surface of the sleeve has a top surface and a thru hole defined therein, an outer surface of the main piston would slideably bear against an inner surface of the external flange of the piston bore housing, a main piston seal is adhered to the main and is u-shaped where a base of the main piston seal is adhered to the top surface of the main piston, the main piston seal bears against the inner surface and an external surface defined by the gap in the main piston seal, the bottom surface of the main piston has a plurality of counterbores defined therein, the plurality of counterbores provide positional location and recesses for the main piston and for a plurality of piston springs;

o. the staging housing is a cylinder of revolution and has a thru-hole defined therein, a top surface of the staging housing has a plurality of counterbores defined therein, where the counterbores provided have a depth that allows the plurality of piston springs to have a slip fit and therefore allow the piston springs to protrude above the top surface of the staging housing, a first series of air-ports is shown on the top surface of the staging housing where a first series of air-ports are aligned with and directly communicate with the second series of thru-holes located in the piston bore housing, the first series of air-ports penetrating therethrough and allow compressed air to communicate with the series of thru-holes located in the staging housing thereby providing compressed air to actuate a plurality of separation pin assemblies, the first series of air ports have a counterbore defined therein to accommodate a first series of o-rings, a second series of air-ports is shown on the top surface of the staging housing where the second series of air-ports penetrate through the top surface of the staging housing and exit into the thru-hole via a plurality of exit ports, the second series of air-ports have a counterbore defined therein to accommodate a second series of o-rings, the first and second series of o-rings providing a seal between the piston bore housing and the staging housing;

p. a sleeve is provided having a "L" shaped cross section cylinder of revolution and having a centrally positioned cylinder, and an outward extending flange, the sleeve has a central through hole defined therein, a plurality of slots are situated around the centrally positioned cylinder, the slots allowing an ejecting finger to pivot through, the polarity of slots extend through the through hole, the plurality of slots are equally circumferentially positioned, interspaced and equally circumferentially located between the plurality of slots are separation pin assembly holes, the sleeve has a top surface located on the outward extending flange and is provided with a first clocking hole and a second clocking hole which is defined therein, a first and second clocking pin are defined on a staging housing extension and are positioned to correctly align the sleeve to the staging housing extension, a top surface of the staging housing extension has a third clocking hole and a fourth clocking hole defined therein, the third and fourth clocking holes defined therein are recesses that permit a corresponding third clocking pin and a fourth clocking pin to be positioned and located on a bottom surface of the staging housing;

q. positioned on the top surface of the outward extending flange of the sleeve is the staging housing extension, which is located using the first and second clocking pins and first and second clocking holes, the staging housing extension is defined as a cylinder of revolution and has a central hole defined therein, the staging housing extension additionally has a plurality of cutouts defined therein which allow a plurality of finger pivot assemblies to be positioned therein, and to have clearance to allow the ejecting finger on each finger pivot assembly to easily rotate and translate therein, the finger pivot assemblies are situated to allow each of ejecting finger of the finger pivot assembly to pass through the slots located in the sleeve;

r. a component mounting board is provided, the component mounting board is attached to the end cover, a first and a second solenoid area attached to the component mounting board, and are three-way solenoids, the three way solenoids provide pressurized air to activate the mechanisms, and allow pressure relief after the activation of the sanitary hands-free lid dispenser, a third solenoid is provided and is a two-way solenoid as there is no requirement to provide relief of the air pressure, an air manifold is provided and is centrally positioned towards the top of the component mounting board, the air solenoid providing pressurized air to each solenoid, a fuse and connector or input is located towards the bottom of the end cover and provides between 5 volts and 24 volts to the electrical system, a fuse and cover are shown positioned towards the middle portion of the end cover, towards the middle top of the end cover an input supply air fitting is provided, input pressure should be between 30 psi and 35 psi, the input supply air fitting communicates with the air manifold which supplies pressurized air to the first solenoid, the second solenoid, and the third solenoid;

s. the first second and third solenoids each have a pair of air tubes attached, the first solenoid has a first input air tube connecting to the air manifold and has a first output air tube connecting the first solenoid to a first air fitting which provides compressed air to the main piston and activates the finger pivot assemblies, the second solenoid has a second input air tube connecting to the air manifold and additionally has a second output air tube connecting to a second air fitting providing compressed air to the separation pin assemblies, the third solenoid has a third input air tube connected to the air manifold and has a third output air tube connected to a third air fitting providing compressed air to "fluff" the beverage lids to assist in dispensing the beverage lids to the catch tray;

t. a first timer is electrically connected to the first solenoid, a second timer is electrically connected to the second solenoid, and a third timer is electrically connected to the third solenoid, the first, second, and third timers sequentially actuate the first, second, and third solenoids; and u. the hands-free lid dispenser has a first support bracket and a second support bracket that are mounted on opposing sides of the end cover, a stand is provided, the stand has a first vertical portion and a second vertical portion that are connected to each other with a base, where the base may be circular or rectangular in shape, the first and second support brackets are rectangular in shape and have holes on a top surface and a bottom surface that are adapted to receive the vertical portions of the stand.

16. The sanitary hands-free lid dispenser of claim 15, wherein:

a. the separation pin assembly comprises a separation pin body, the separation pin body has an exterior surface, a first groove, a second groove, and a third groove defined therein, the separation pin body further has a front surface, where the front surface of the separation pin body has a central hole defined therein that permits a separation pin to separate one beverage lid from the stack of lids, the separation pin assembly has a first O-ring positioned in the first groove and a second O-ring positioned in the third groove of the separation pin body;

b. the separation pin body has an internal cavity defined therein, the internal cavity is sized to allow a separation pin piston to slidably translate through the internal cavity, the separation pin piston has provisions to fix the separation pin centrally in the separation pin piston, the separation pin piston has counterbored portion defined therein and allows a separation pin spring (or spring) to be positioned in and around the separation pin;

c. a counterbored recess provides a positional location for the spring, the separation pin body further has a separation pin air-port (or air-port) defined therein, the air-port communicates with the internal cavity of the separation pin body;

d. the air-port in the separation pin body communicates with the third threaded fitting providing compressed air to actuate the separation pin piston and extend the separation pin, reducing the air pressure causes the spring to return the separation pin piston and the separation pin to rest against a separation pin end cap; and e. the separation pin end cap is positioned at an end opposing the separation pin and seals the separation pin body allowing the compressed air to actuate the separation pin piston, a groove is provided in the separation pin end cap that accommodates an o-ring and is positionally biased towards the separation pin piston pressure leakage is prevented by, the separation pin piston having a groove medially positioned on the separation pin piston thereby accommodating an o-ring that is positioned within the groove, the separation pin end cap is threadably attached to the separation pin body, the separation pin assemblies being slideably inserted onto the separation pin assembly holes allowing the first series of air-ports to communicate with the air-port in the separation pin assembly.

17. The sanitary hands-free lid dispenser of claim 15, wherein the finger pivot assembly comprises a finger pivot anchor, the finger pivot anchor is essentially a rectangular shape that has a protruding boss that has two threaded holes defined therein, the two threaded holes threadably attach two screws that prevent any dislocation of the finger pivot anchor when activated the two screws secure the finger pivot assembly in the staging housing, the ejecting finger or staging finger is pivotably attached to a staging housing that has a first hole defined therein, a first press fit pin is inserted thru the staging housing and staging finger and allows for rotation and translation, the finger pivot assemblies further have an shoulder cap screw and a spring attached to a finger drive shaft, the finger drive shaft is essentially cylindrical in shape, and has a top that has a threaded hole defined therein which allows the shoulder cap screw to be threadably attached, towards the bottom of the finger drive shaft a thru slot is provided, the thru slot allows a second press fit pin to be slideably and translatably positioned and secured in a second hole in the staging finger, the staging finger has a length which terminates into a support, the support allows beverage lids to rest thereupon, the staging finger further has a projection, or thumb that snares the edge of a lid when the finger pivot assembly is activated.

* * * * *